US011325729B2

(12) United States Patent
Davis

(10) Patent No.: US 11,325,729 B2
(45) Date of Patent: May 10, 2022

(54) LID PICK AND PLACE SYSTEM AND METHOD OF USE THEREOF

(71) Applicant: Winpak Lane, Inc., San Bernardino, CA (US)

(72) Inventor: Steven Davis, San Bernardino, CA (US)

(73) Assignee: Winpak Lane, Inc., San Bernardino, CA (US)

( * ) Notice: Subject to any disclaimer, the term of this patent is extended or adjusted under 35 U.S.C. 154(b) by 0 days.

(21) Appl. No.: 16/994,917

(22) Filed: Aug. 17, 2020

(65) Prior Publication Data

US 2022/0048654 A1 Feb. 17, 2022

(51) Int. Cl.
*B65B 7/28* (2006.01)
*B65B 57/10* (2006.01)
*B65B 43/44* (2006.01)

(52) U.S. Cl.
CPC ..... *B65B 7/2807* (2013.01); *B65B 7/2828* (2013.01); *B65B 43/44* (2013.01); *B65B 57/10* (2013.01)

(58) Field of Classification Search
None
See application file for complete search history.

(56) References Cited

U.S. PATENT DOCUMENTS 1,864,008 A * 6/1932 Pierce ..... B67B 3/062 53/488
2,325,163 A * 7/1943 Goodwin ..... B67B 3/02 53/141
3,487,622 A * 1/1970 Mueller ..... B65B 7/2842 53/282
3,545,173 A * 12/1970 Christine ..... B65B 7/2878 53/307
4,135,347 A * 1/1979 Lowdermilk ..... B65B 3/027 156/212
4,750,312 A * 6/1988 de Vaujany ..... B65B 7/2807 53/307
4,866,907 A * 9/1989 Iuchi ..... B65B 7/28 53/299
5,553,536 A * 9/1996 Van Os ..... B41F 15/0827 101/44
6,745,541 B2 * 6/2004 Sakurazawa ..... B65B 7/2807 53/307

* cited by examiner

*Primary Examiner* — Hemant Desai
*Assistant Examiner* — Tanzim Imam
(74) *Attorney, Agent, or Firm* — The Watson IP Group, PLC; Jovan N. Jovanovic

(57) ABSTRACT

A lid pick and place system having a primary magazine assembly and a pick and place assembly. The primary magazine assembly includes a base plate and at least one guide rod extending therefrom to define an elongated lid chamber with at least one lid bore. Rotation of the at least one guide rod within the at least one guide rod bore directs at least a portion of a lower offset flange beyond a lid bore perimeter and into a path of the elongated lid chamber. The pick and place assembly includes a connecting rod with a suction cup. A linear movement assembly is structurally configured to move the connecting rod linearly closer and further from the lower surface of the base plate. A rotative movement assembly structurally configured to rotate the connecting rod relative to the lower surface of the base plate.

14 Claims, 24 Drawing Sheets

LID PICK AND PLACE SYSTEM AND METHOD OF USE THEREOF

CROSS-REFERENCE TO RELATED APPLICATION

NA

BACKGROUND OF THE DISCLOSURE

1. Field of the Disclosure

The disclosure relates in general to packaging equipment, and more particularly, to a lid pick and place system structurally configured to apply lids to cups, for example, single serving cups, while other variations are contemplated.

2. Background Art

In many instances, a variety of products, such as, for example, foodstuffs and the like are sold and offered in single use cups which are typically covered with a lid. Among other applications, such cups are often utilized to contain dressings, dips, sauces, spreads, butters, dairy products, creams, non-dairy creams. Such cups come in a variety of sizes and shapes, and generally hold between 3 ml and 200 ml, and more commonly 8 ml to 16 ml (the foregoing sizes are meant to be illustrative and not to be deemed limiting).

To complete the filling process, it is necessary to quickly and easily apply the lids to the cup after filling. Among other problems, such lids can be difficult to apply and properly align with the outer rim of the cup. In other instances, it becomes difficult to individually grasp and retain the lids for application onto cups.

With the increasing requirements for speed as well as ease of use, maintenance and setup, there is always a need to improve the application of lids onto cups to form the necessary containers.

SUMMARY OF THE DISCLOSURE

The disclosure is directed a lid pick and place system comprising a primary magazine assembly and a pick and place assembly. The primary magazine assembly includes a base plate and at least one guide rod. The base plate has a lower surface, an upper surface and at least one lid bore. The at least one lid bore defines a lid bore perimeter having at least one guide rod bore extending therethrough. The at least one guide rod extends from the base plate about the base plate to define an elongated lid chamber collectively with the at least one lid bore. The at least one guide rod has a body with a first end and a second end, and a lower offset flange at the second end, with the at least one guide rod extending through the at least one guide rod bore so that the lower offset flange approaches the lower surface of the base plate. Rotation of the at least one guide rod within the at least one guide rod bore directs at least a portion of the lower offset flange beyond the lid bore perimeter and into a path of the elongated lid chamber.

The pick and place assembly includes a connecting rod, a linear movement assembly and a rotative movement assembly. The connecting rod has at least one suction cup mounted thereto and positionable so as to underlie the lower surface of the base plate within the path of the elongated lid chamber. The linear movement assembly is structurally configured to move the connecting rod linearly closer and further from the lower surface of the base plate. The rotative movement assembly is structurally configured to rotate the connecting rod relative to the lower surface of the base plate.

In some configurations, the linear movement assembly further comprises a pair of opposing linear guides fixed relative to the base plate each having a slide block slidably movable therealong. The connecting rod is rotatably attached to each of the slide blocks.

In some configurations, wherein the rotative movement assembly further comprises a connecting arm and a cam plate. The connecting arm is coupled to the connecting rod. The connecting arm has a distal end spaced apart from an axis of rotation of the connecting arm, with a follower mounted proximate the distal end. The cam plate is fixed relative to the base plate and including a cam surface, with the follower positionable within the cam surface and movable therewithin between a first end and a second end. Movement of the follower between the first end and the second end of the cam surface causes the connecting arm to rotate relative to the slide blocks about the axis of rotation.

In some configurations, the cam surface is configured to allow the connecting arm to linearly move without rotation proximate the first end of the cam surface and proximate the second end of the cam surface.

In some configurations, the connecting arm rotates through approximately 180° of rotation.

In some configurations, the follower is rotatably coupled to the distal end of the connecting arm.

In some configurations, the vacuum assembly further comprises a plurality of transverse mounts spaced apart from each other along the connecting rod, each having opposing ends with a suction cup associated with each of the opposing ends of the transverse mounts. Each of the suction cup are in fluid communication with a central bore of the connecting rod.

In some configurations, the each of the opposing linear guides comprises a pair of spaced apart elongated rods with each slide block having a pair of spaced apart openings slidably engageable with one of the spaced apart elongated rods.

In some configurations, the at least one guide rod further includes a plurality of guide rods associated with each of the at least one lid bore. Each of the guide rods are positioned so that the lower offset flange is positionable within the path of the elongated lid chamber.

In some configurations, the primary magazine assembly further comprises an inner upper plate. The upper inner plate has a lower surface and an upper surface. At least one upper lid bore corresponding to the lid bore of the base plate. At least one upper guide rod bore corresponding to the at least one guide rod bore of the base plate, and a key bore associated with the upper lid bore. The guide rod further includes an annular slot spaced apart from the second end to define an upper cap region, and a guide rod lock washer insertable within the annular slot. With the insertion of the guide rod lock washer into the annular slot, the guide rod lock washer can be inserted into the key bore. The primary magazine assembly further comprises an outer upper plate securable to the upper surface of the inner upper plate. In such an orientation, the outer upper plate sandwiches the guide rod lock washer within the key bore to preclude slidable movement between the at least one guide rod relative to the inner upper plate, while facilitating rotative movement therebetween.

In some configurations, the guide rod lock washer is biased against the at least one guide rod within the key bore, to, preclude inadvertent rotational movement of the at least one guide rod relative to the inner upper plate.

In some configurations, the at least one guide rod comprises a plurality of guide rods positioned about the perimeter of the at least one lid bore.

In some configurations, the system further comprises a removable magazine assembly attachable to the primary magazine assembly. The removable magazine assembly has at least one removable elongated lid chamber positionable to correspond to the elongated lid chamber of the primary magazine assembly, so as to direct lids from the removable magazine assembly into the elongated lid chamber of the primary magazine assembly.

In some configurations, the removable magazine assembly further includes a lid retaining assembly structurally configured so that lids are selectively precluded from passage out of the removable magazine assembly to the primary magazine assembly.

In some configurations, the lid retaining assembly further comprises at least one retainer pin selectively insertable into a path of the removable elongated lid chamber, to, in turn, selectively block the path.

In another aspect of the disclosure, the disclosure is directed to a primary magazine assembly for a pick and place system. The primary magazine comprises a base plate and at least one guide rod. The base plate has a lower surface, an upper surface and at least one lid bore, the at least one lid bore defining a lid bore perimeter having at least one guide rod bore extending therethrough. The at least one guide rod extends from the base plate about the base plate to define an elongated lid chamber collectively with the at least one lid bore. The at least one guide rod has a body with a first end and a second end, and a lower offset flange at the second end, with the at least one guide rod extending through the at least one guide rod bore so that the lower offset flange approaches the lower surface of the base plate. Rotation of the at least one guide rod within the at least one guide rod bore directs at least a portion of the lower offset flange beyond the lid bore perimeter and into a path of the elongated lid chamber.

In some configurations of this aspect of the disclosure, the primary magazine assembly further includes an inner upper plate, the upper inner plate having a lower surface and an upper surface, and with at least one upper lid bore corresponding to the lid bore of the base plate. At least one upper guide rod bore corresponds to the at least one guide rod bore of the base plate, and a key bore is associated with the upper lid bore. The guide rod further includes an annular slot spaced apart from the second end to define an upper cap region, and a guide rod lock washer insertable within the annular slot. With the insertion of the guide rod lock washer into the annular slot, the guide rod lock washer can be inserted into the key bore. Additionally, the primary magazine assembly further comprises an outer upper plate securable to the upper surface of the inner upper plate. The outer upper plate sandwiches the guide rod lock washer within the key bore to preclude slidable movement between the at least one guide rod relative to the inner upper plate, while facilitating rotative movement therebetween.

In some configurations, the at least one guide rod further includes a plurality of guide rods associated with each of the at least one lid bore. Each of the guide rods positioned so that the lower offset flange is positionable within the path of the elongated lid chamber. The offset flange can be rotated to adjust the amount of restriction for lids exiting the bore.

In yet another aspect of the disclosure, the disclosure is directed to a pick and place assembly for a pick and place system comprising a connecting rod, a linear movement assembly and a rotative movement assembly. The connecting rod has at least one suction cup mounted thereto and positionable so as to underlie the lower surface of a base plate within a path of an elongated lid chamber. The linear movement assembly is structurally configured to move the connecting rod linearly closer and further from the lower surface of the base plate. The rotative movement assembly is structurally configured to rotate the connecting rod relative to the lower surface of the base plate.

In some configurations, the linear movement assembly further comprises a pair of opposing linear guides fixed relative to the base plate each having a slide block slidably movable therealong. The connecting rod is rotatably attached to each of the slide blocks. The rotative movement assembly further comprises a connecting arm, and a cam plate. The connecting arm is coupled to the connecting rod. The connecting arm has a distal end spaced apart from an axis of rotation of the connecting arm, with a follower mounted proximate the distal end. The cam plate is fixed relative to the base plate and including a cam surface, with the follower positionable within the cam surface and movable therewithin between a first end and a second end. Movement of the follower between the first end and the second end of the cam surface causes the connecting arm to rotate relative to the slide blocks about the axis of rotation.

BRIEF DESCRIPTION OF THE DRAWINGS

The disclosure will now be described with reference to the drawings wherein.

DETAILED DESCRIPTION OF THE DISCLOSURE

Figure 1:
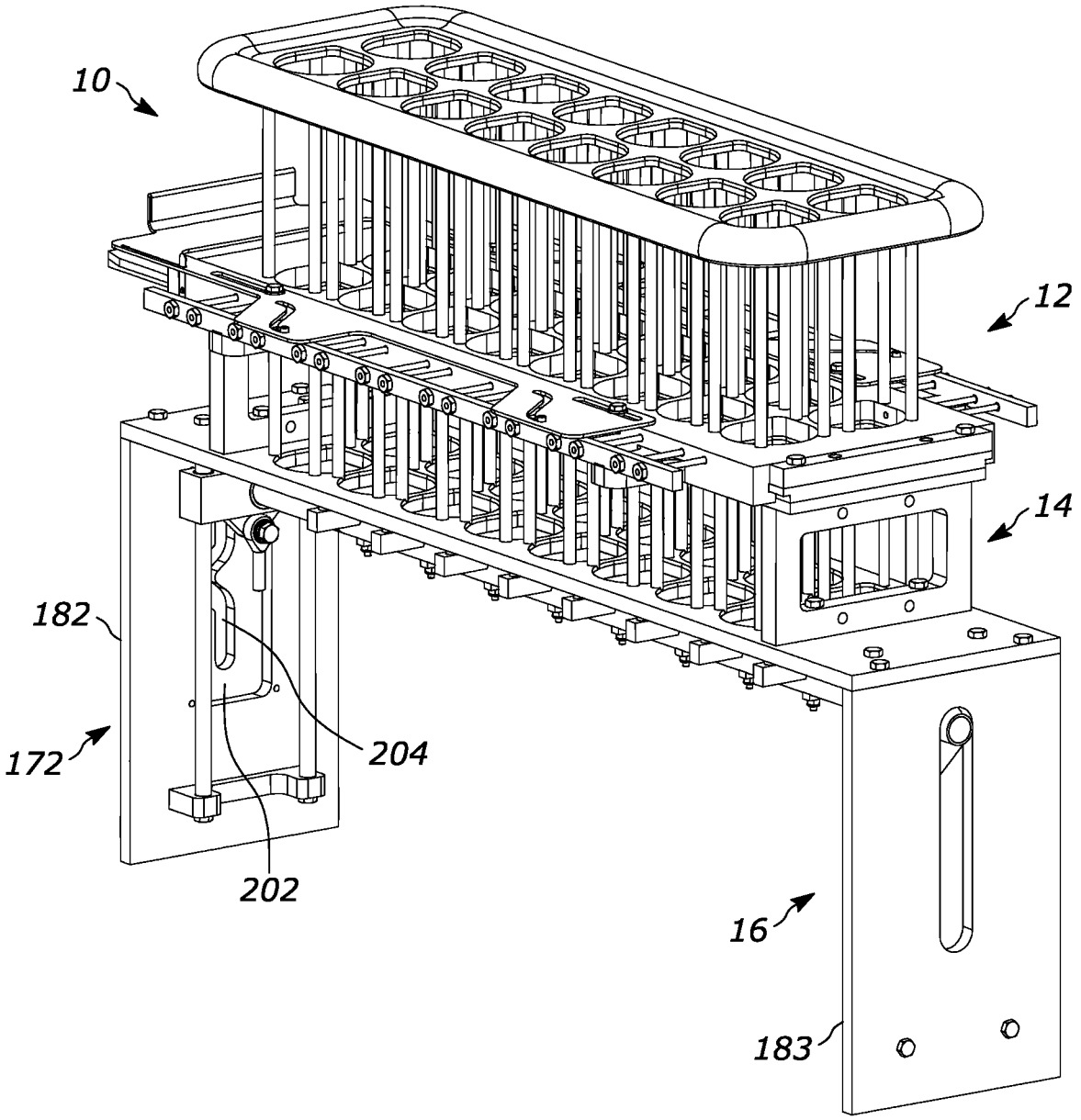
FIG. 1 of the drawings is a top perspective view of the pick and place system of the present disclosure.

While this disclosure is susceptible of embodiment in many different forms, there is shown in the drawings and described herein in detail a specific embodiment(s) with the understanding that the present disclosure is to be considered as an exemplification and is not intended to be limited to the embodiment(s) illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

Figure 2:
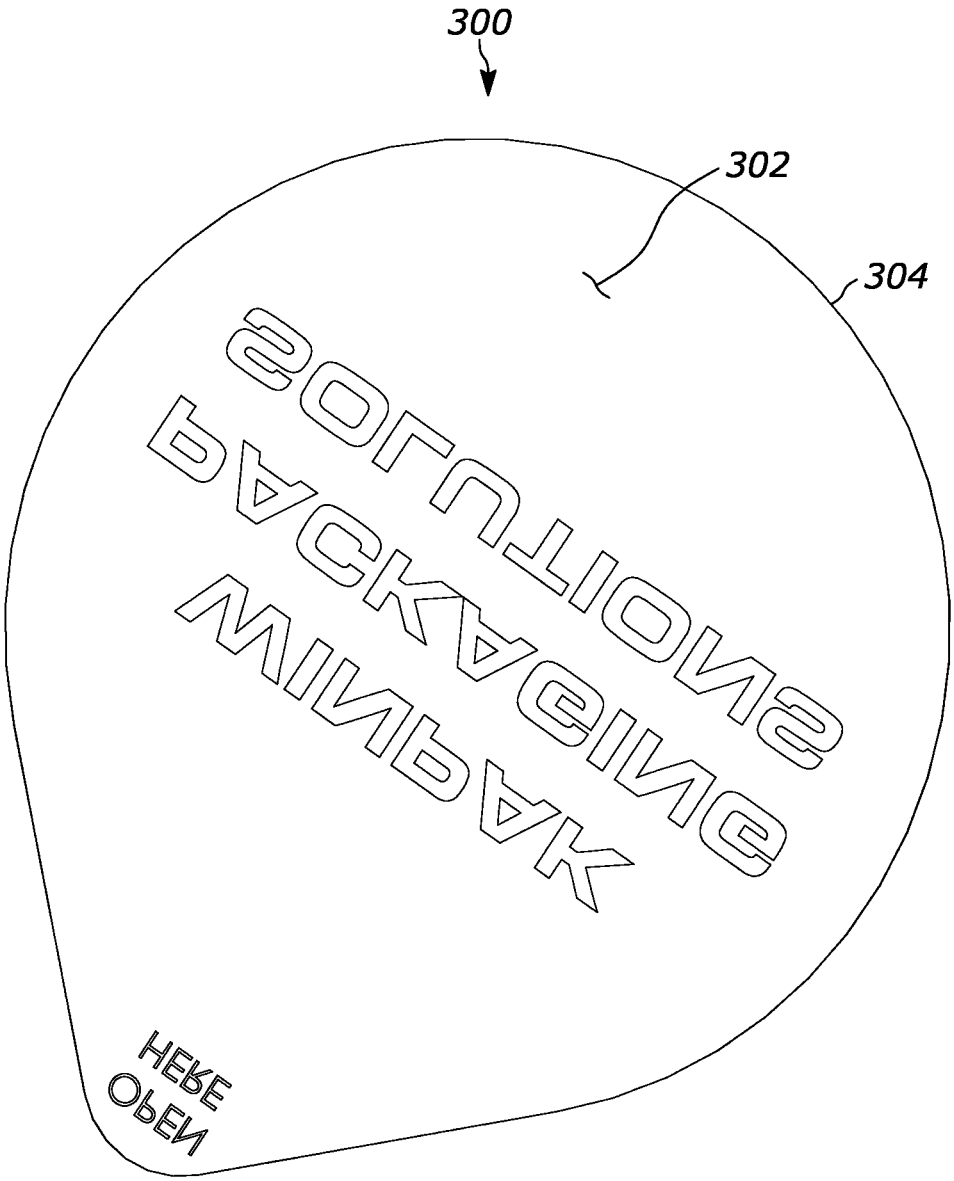
FIG. 2 of the drawings is a top plan view of one exemplary lid with which the system can be utilized, shown as being illustrative, and not to be deemed limiting.
Figure 3:
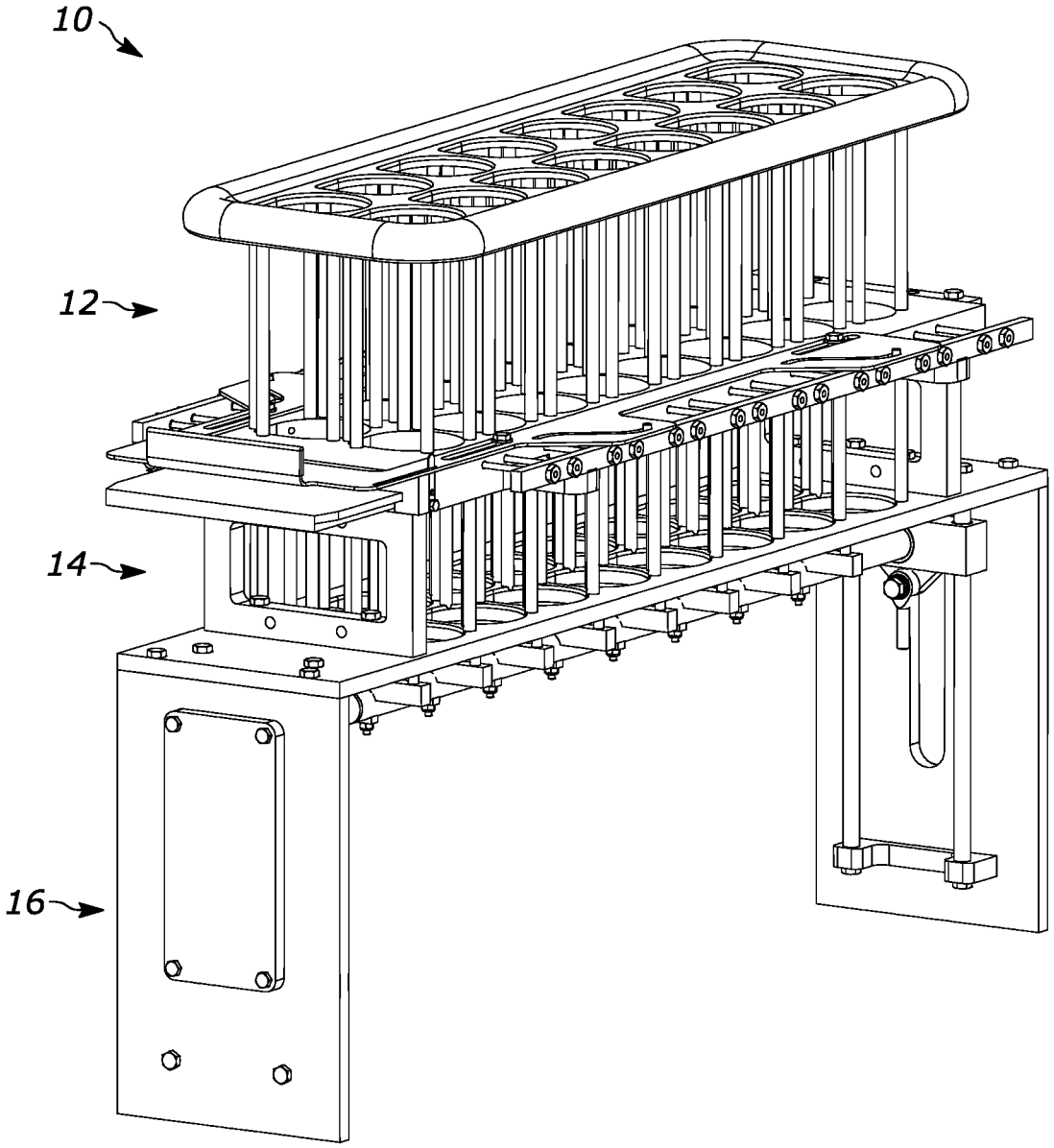
FIG. 3 of the drawings is a bottom perspective view of the pick and place system of the present disclosure.
Figure 4:
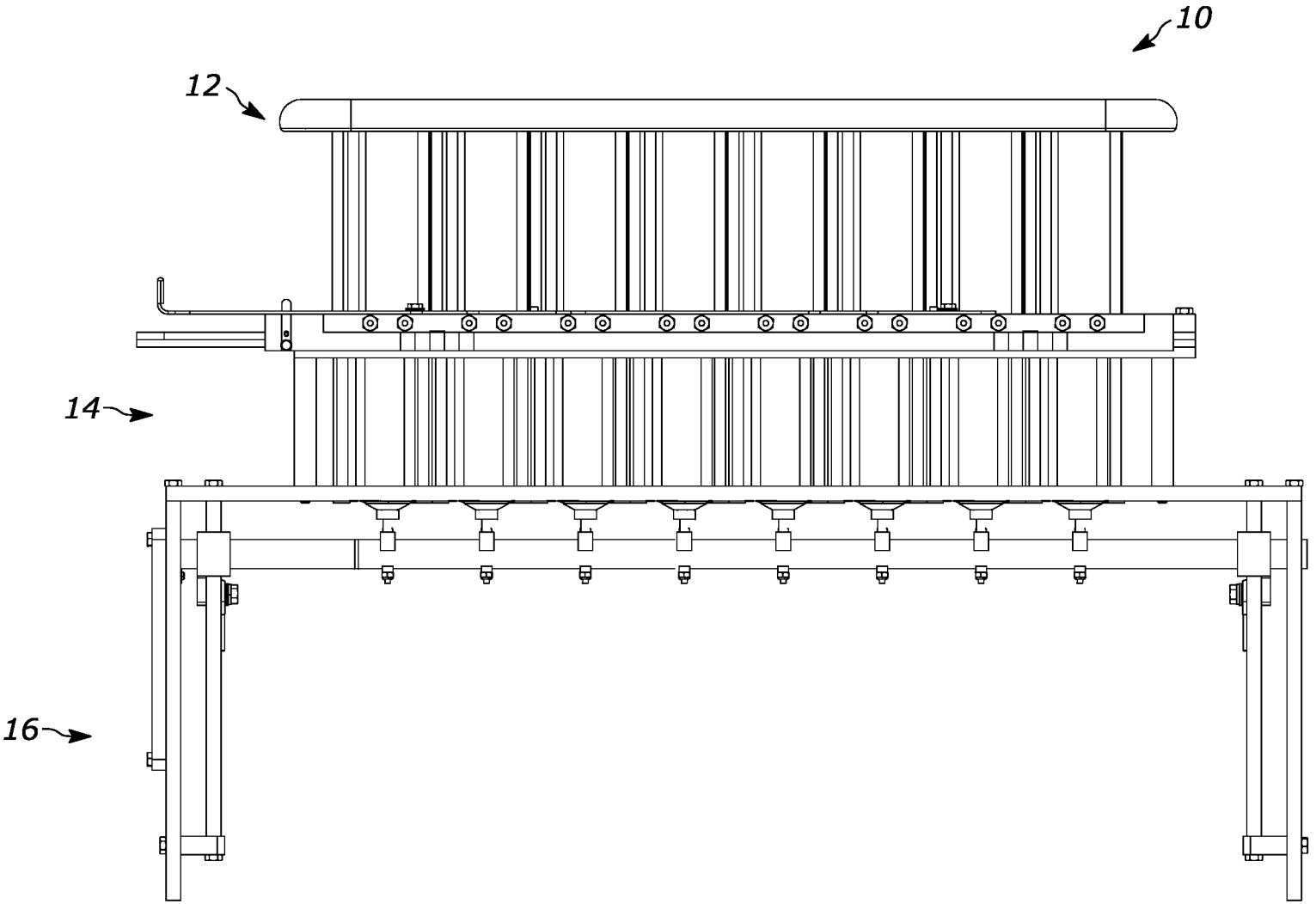
FIG. 4 of the drawings is a side elevational view of the pick and place system of the present disclosure.

Referring now to the drawings and in particular to FIGS. 1, 3 and 4, the lid pick and place system is shown generally at 10. The lid pick and place system is shown generally at 10. The assembly can be utilized for the application of lids (such as lid 300 shown in FIG. 2, having outer perimeter 204 and lower surface 302) of varying size onto cups, which are subsequently secured thereto. The lids may comprise a polymer film, which may include metallization or foil layers, and which may be formed from a plurality of polymer layers that are laminated and/or extruded. The cups may comprise cups in a variety of sizes and shapes, and generally hold between 3 ml and 200 ml, and more commonly 8 ml to 16 ml (the foregoing sizes are meant to be illustrative and not to be deemed limiting). Among other applications, such cups are often utilized to contain dressings, dips, sauces, spreads, butters, dairy products, creams, non-dairy creams. Of course, both the sizes, shapes and applications are solely exemplary and are not to be deemed limiting.

In greater detail, and with reference again to FIGS. 1, 3 and 4, the lid pick and place assembly 10 comprises removable magazine assembly 12, primary magazine assembly 14 and pick and place assembly 16. The removable magazine assembly 12 is removably coupled to the primary magazine assembly and can be removed and reloaded with lids prior to the full dispensing of the primary magazine assembly (or can be removed and replaced with another removable magazine assembly) so as to facilitate continuous operation of the pick and place assembly 16 and the removal of lids from the primary magazine assembly 14 continuously.

Figure 5:
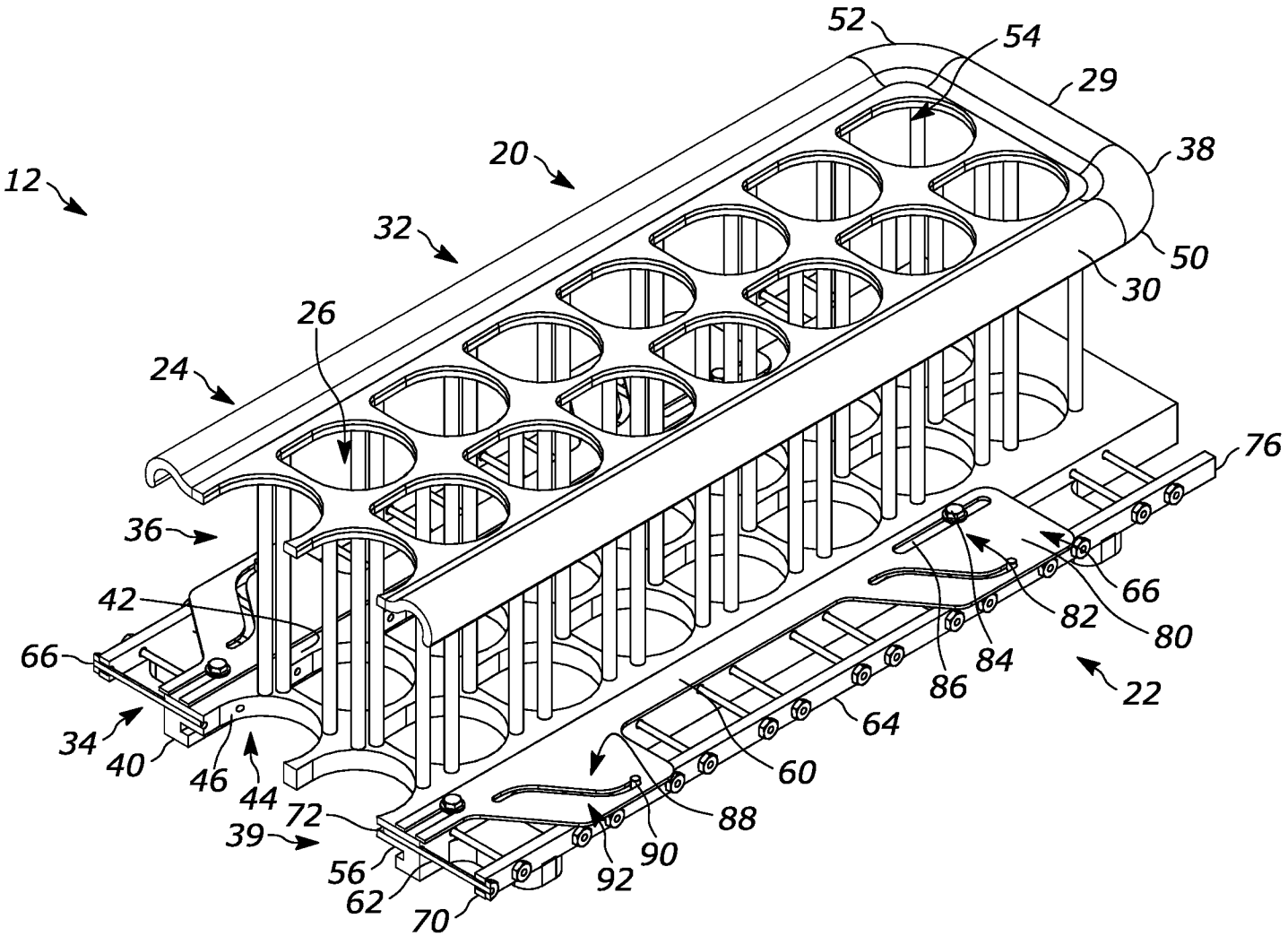
FIG. 5 of the drawings is a partial cross-sectional perspective view of the removable magazine assembly of the present disclosure.
Figure 6:
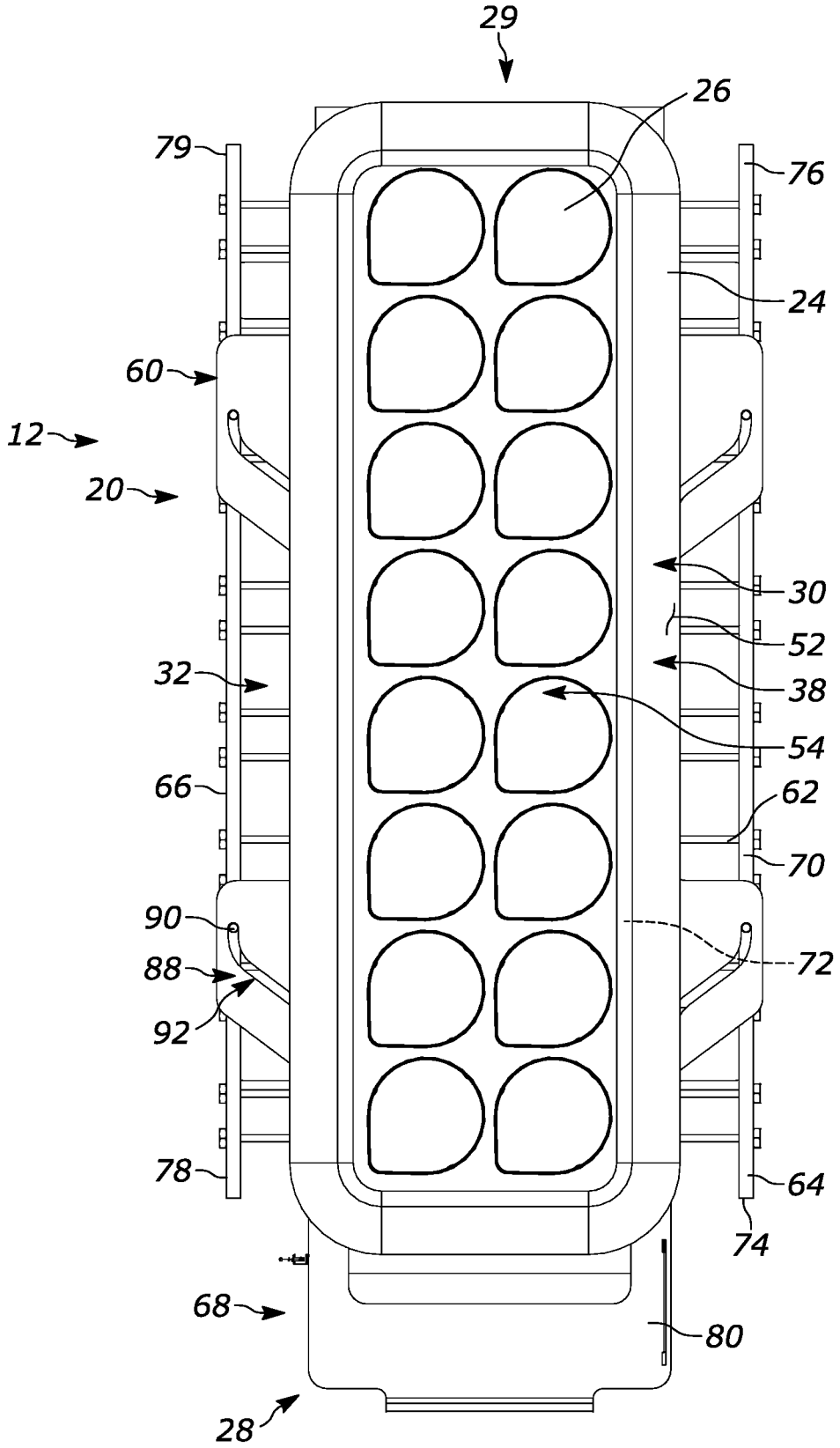
FIG. 6 of the drawings is a top plan view of the removable magazine assembly of the present disclosure.
Figure 7:
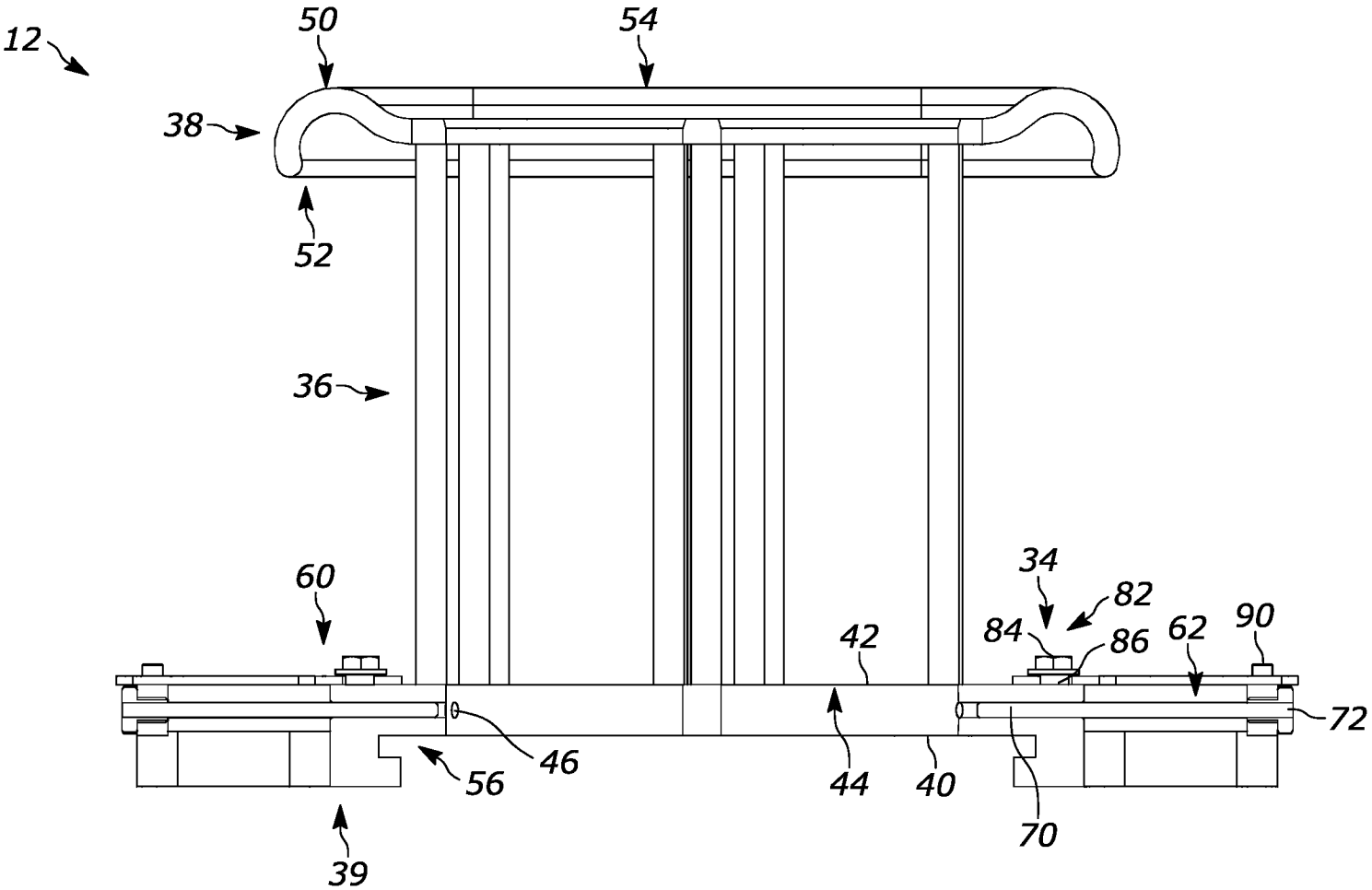
FIG. 7 of the drawings is a cross-sectional view of the removable magazine assembly of the present disclosure.
Figure 8:
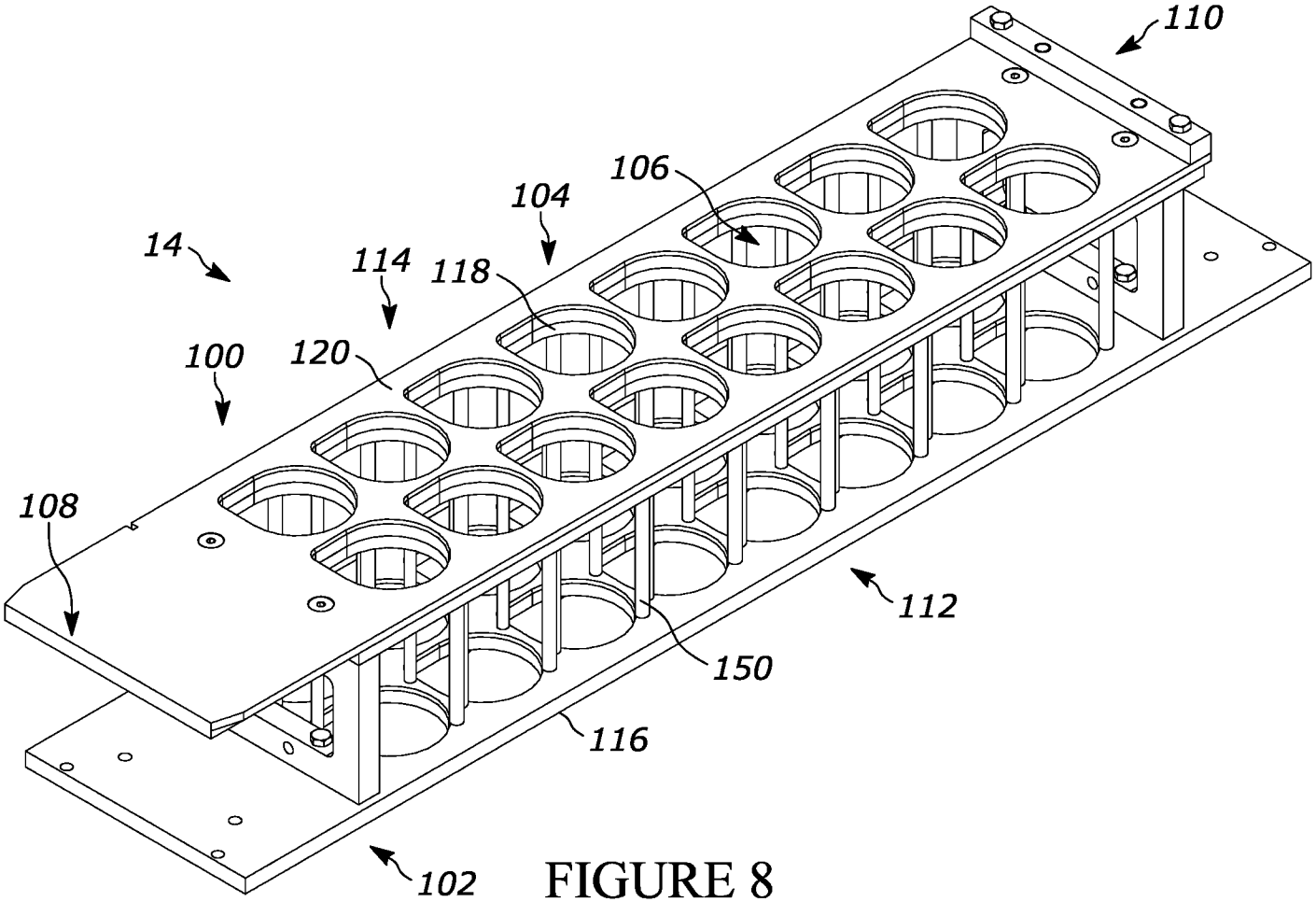
FIG. 8 of the drawings is a top perspective view of the primary magazine assembly of the present disclosure.
Figure 9:
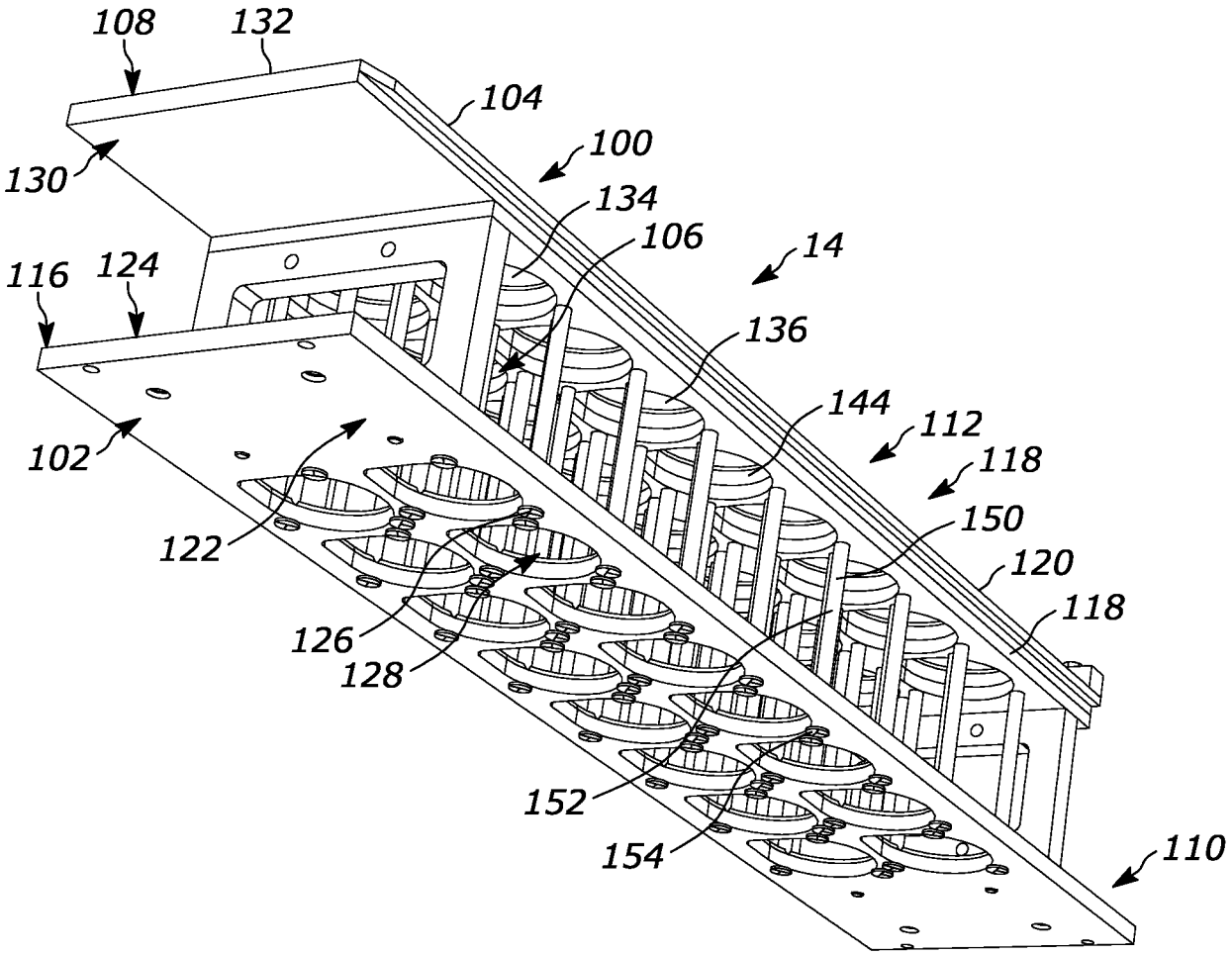
FIG. 9 of the drawings is a bottom perspective view of the primary magazine assembly of the present disclosure.
Figure 10:
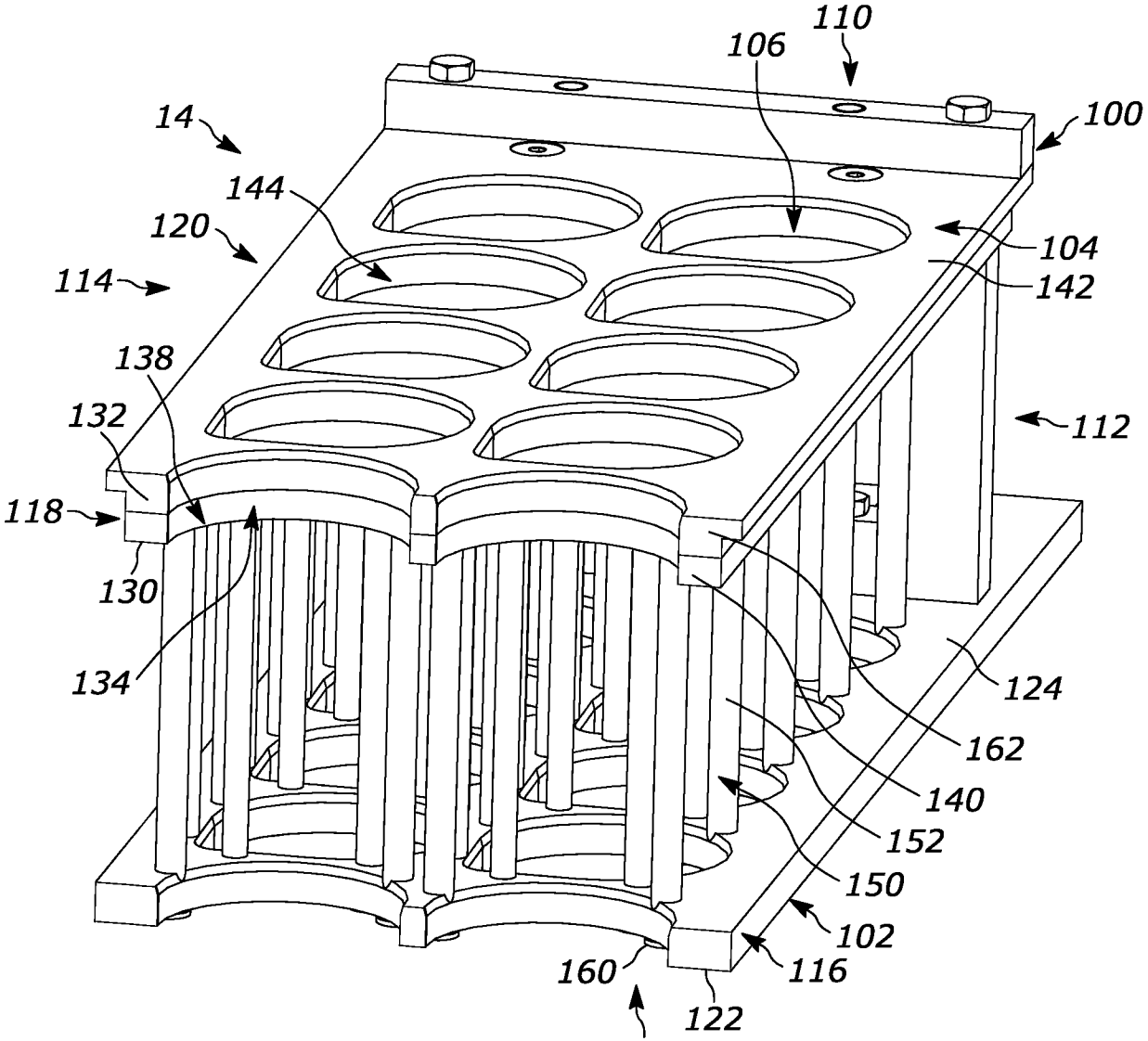
FIG. 10 of the drawings is a partial cross-sectional perspective view of the primary magazine assembly of the present disclosure.
Figure 11:
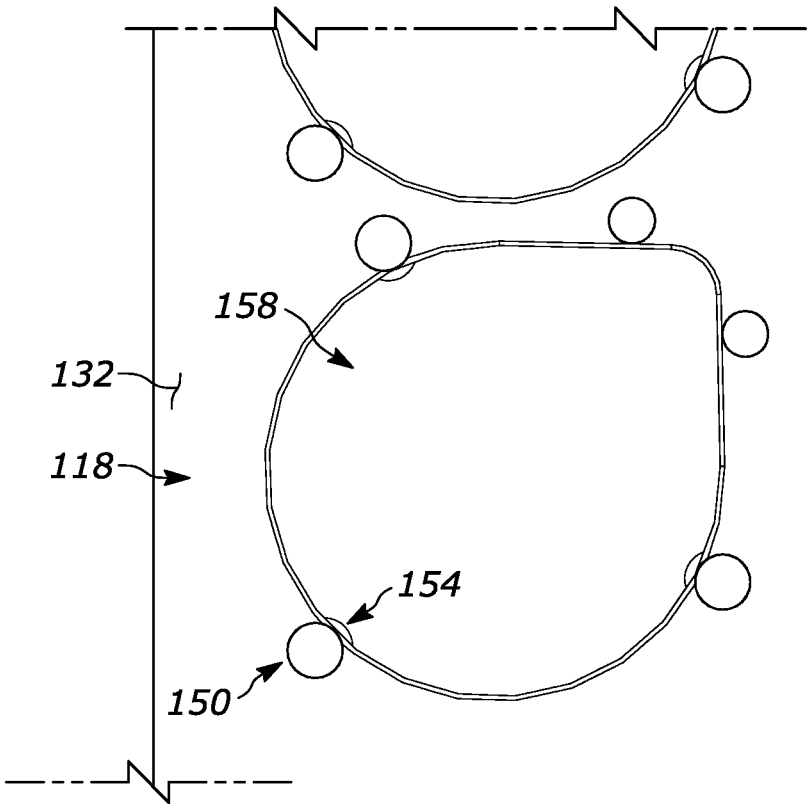
FIG. 11 of the drawings is a partial top plan view of the primary magazine assembly showing, in particular, the portion of the lower offset flange of the guide rod extending into the path of the elongated lid chamber.
Figure 12:
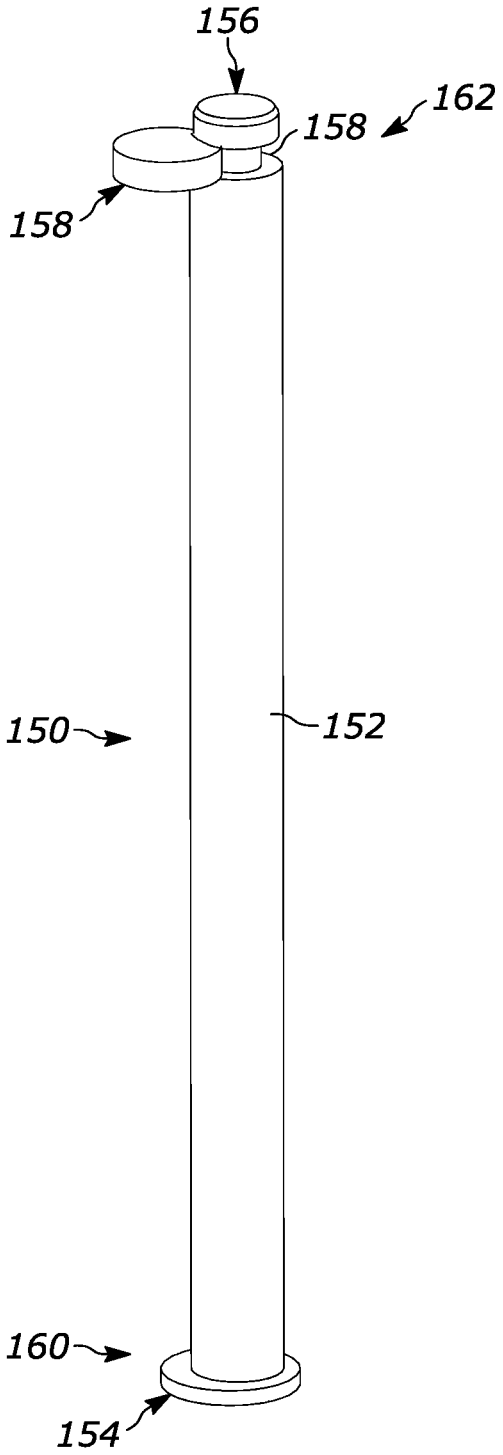
FIG. 12 of the drawings is a perspective view of a guide rod of the present disclosure.
Figure 13:
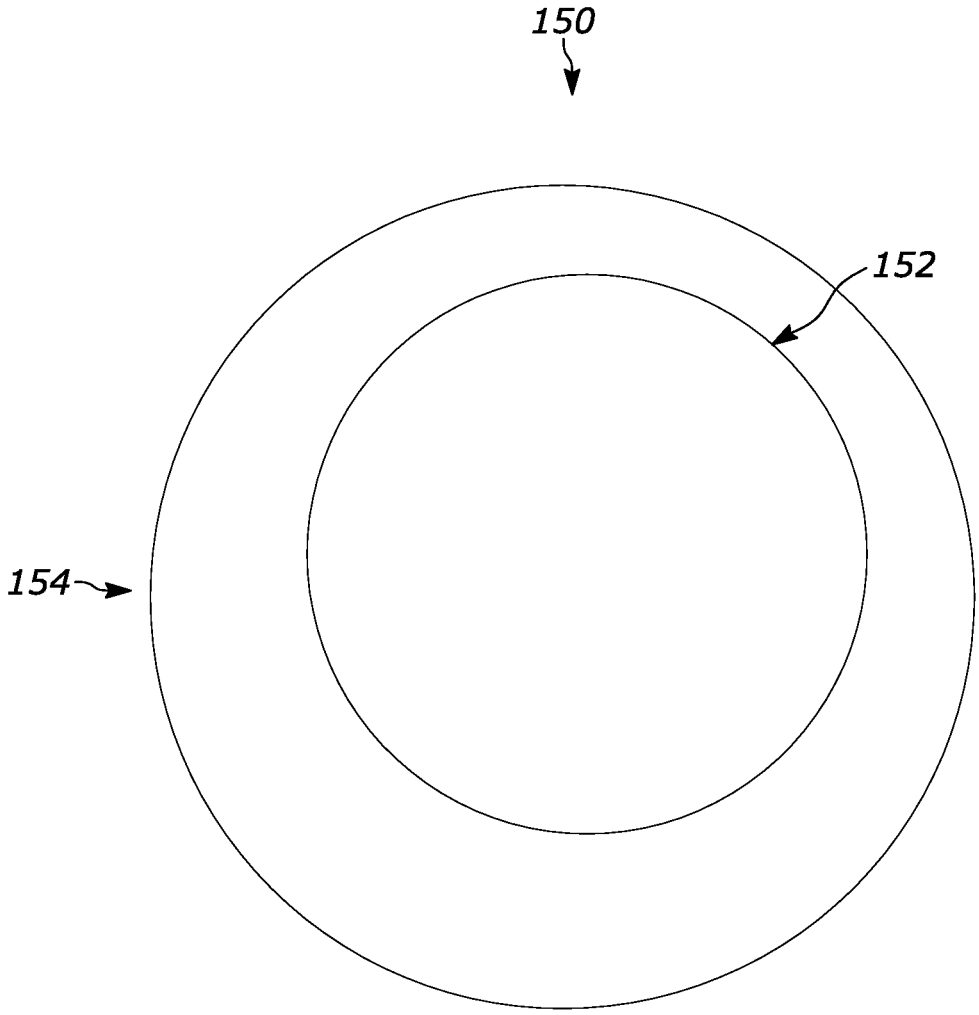
FIG. 13 of the drawings is a top cross-sectional view of the guide rod of the present disclosure showing the lower offset flange.
Figure 14:
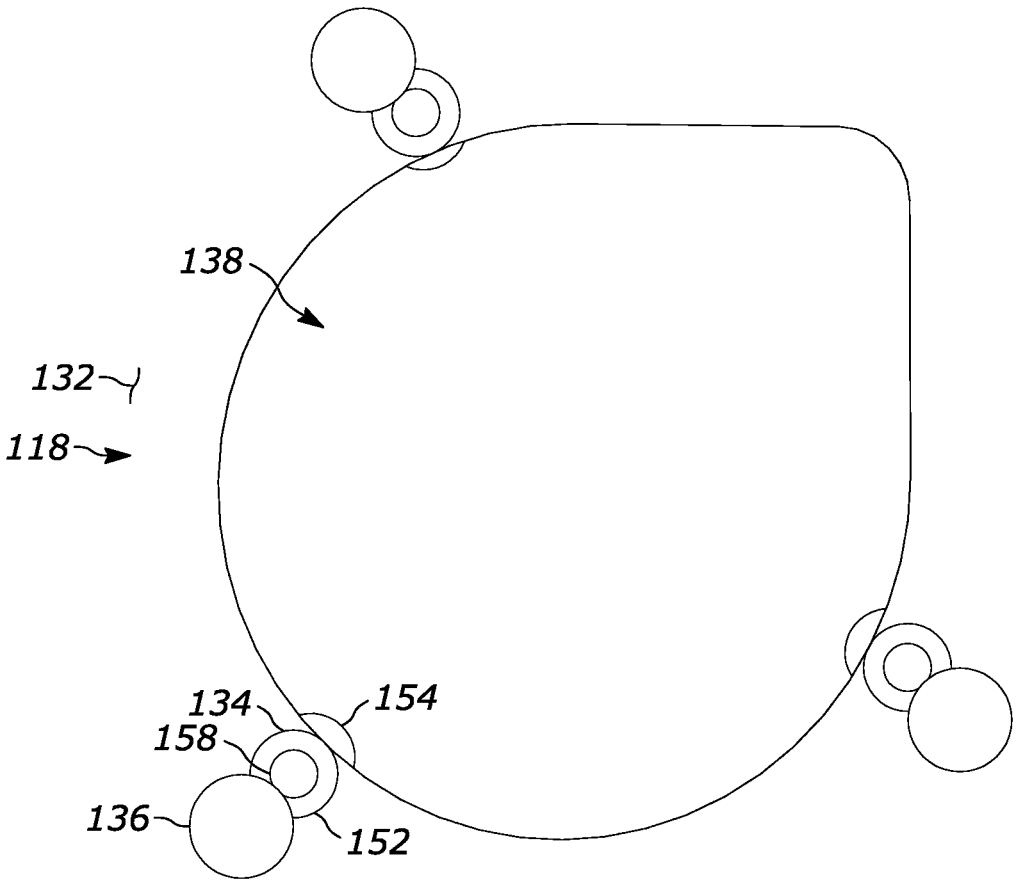
FIG. 14 of the drawings is a cross-sectional view of the primary magazine assembly showing, in particular, the retention of the guide rod lock washer within the key bore engaging the annular slot of the guide rod.
Figure 15:
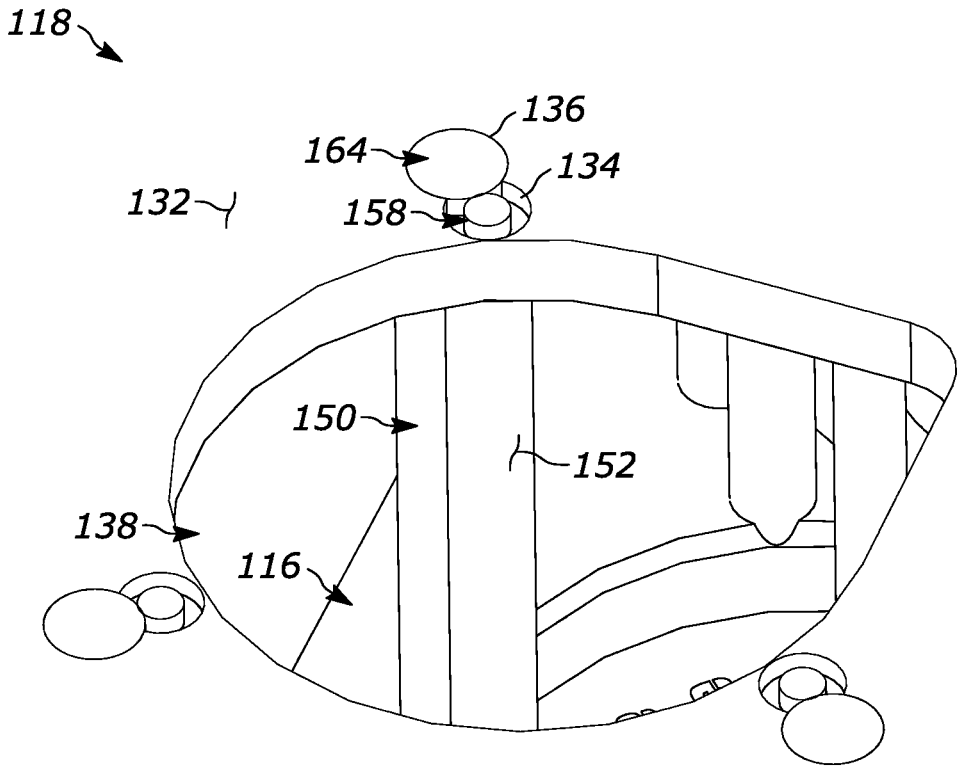
FIG. 15 of the drawings is a perspective cross-sectional view of the primary magazine assembly showing, in particular, the retention of the guide rod lock washer within the key bore engaging the annular slot of the guide rod.
Figure 16:
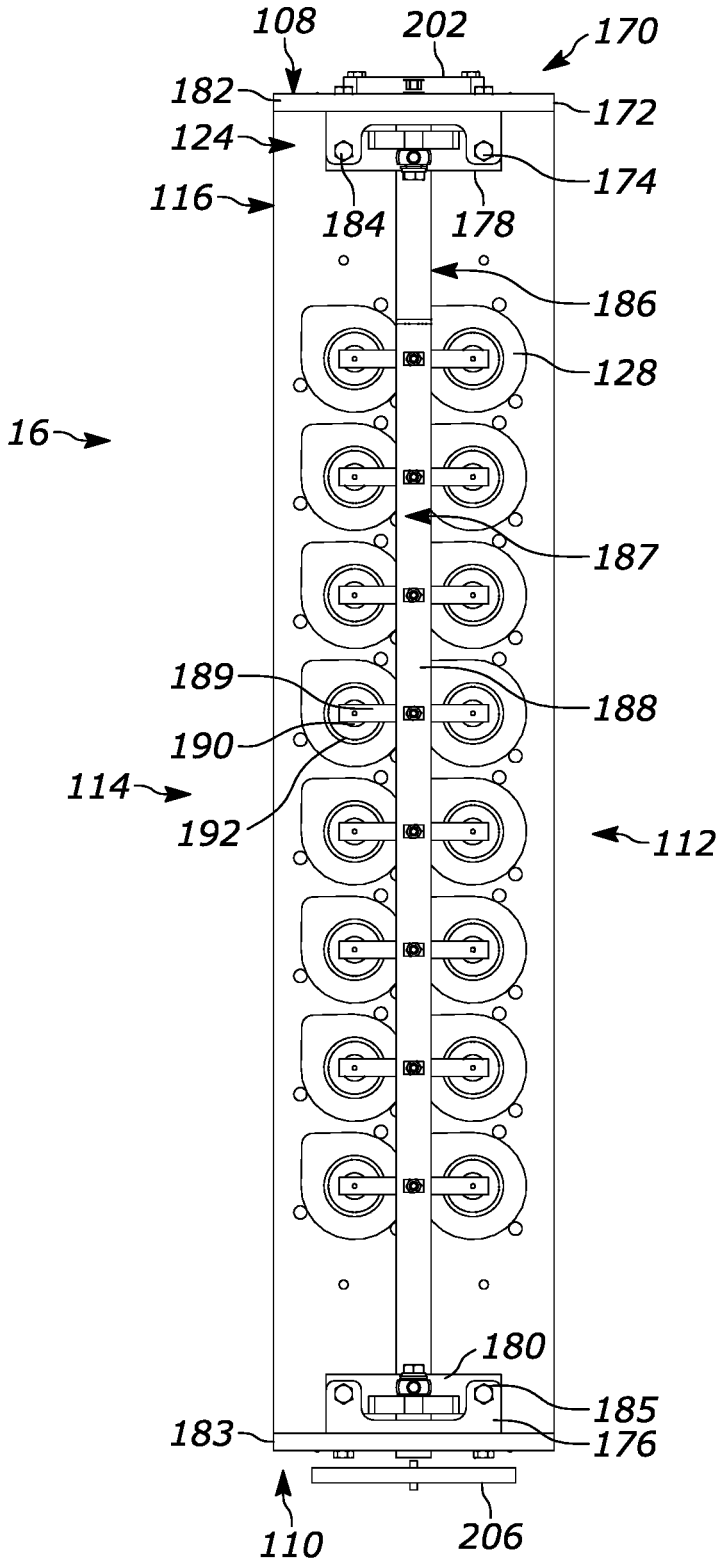
FIG. 16 of the drawings is a bottom plan view of the pick and place assembly of the present disclosure.
Figure 17:
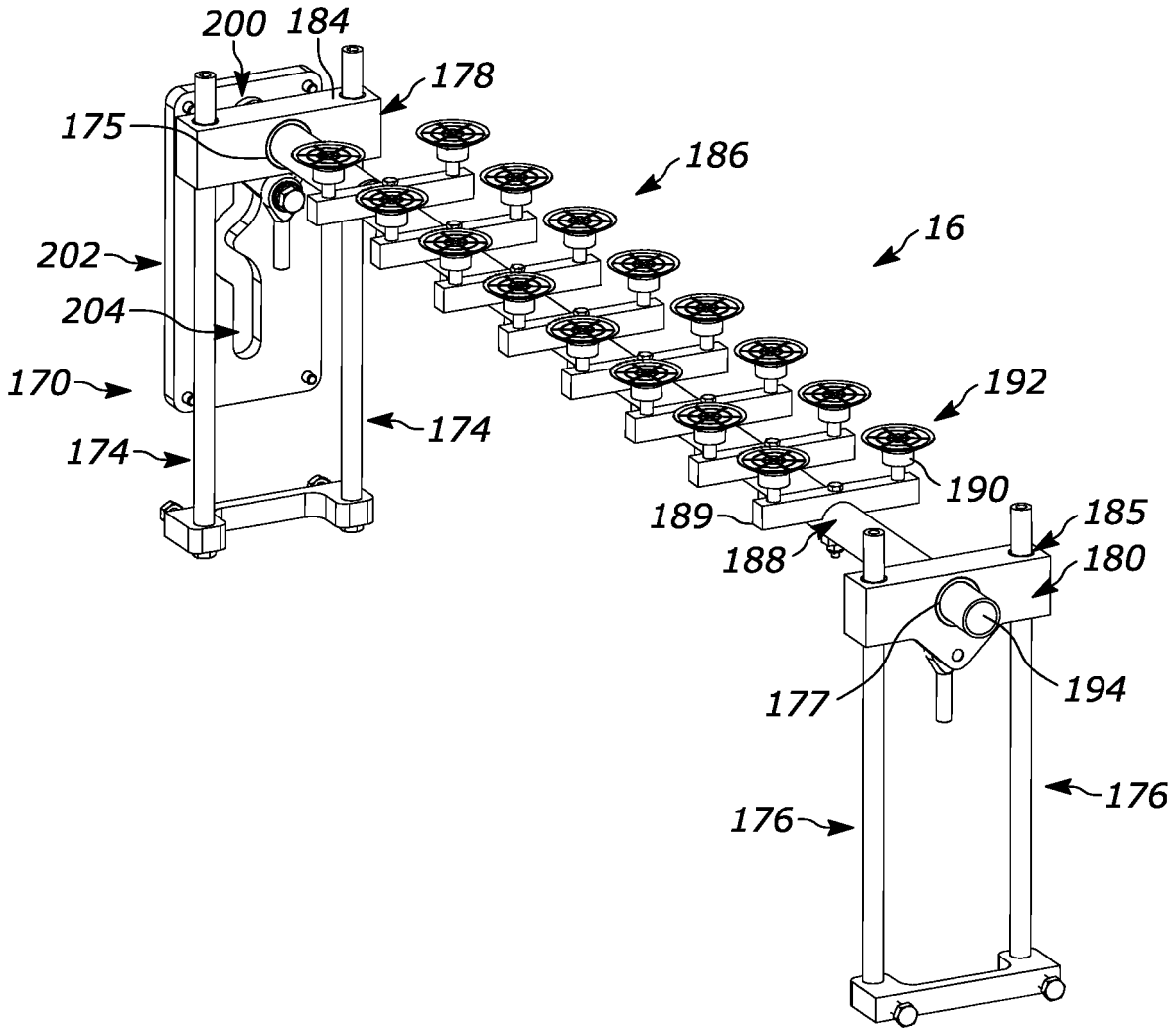
FIG. 17 of the drawings is perspective view of the pick and place assembly of the present disclosure.
Figure 18:
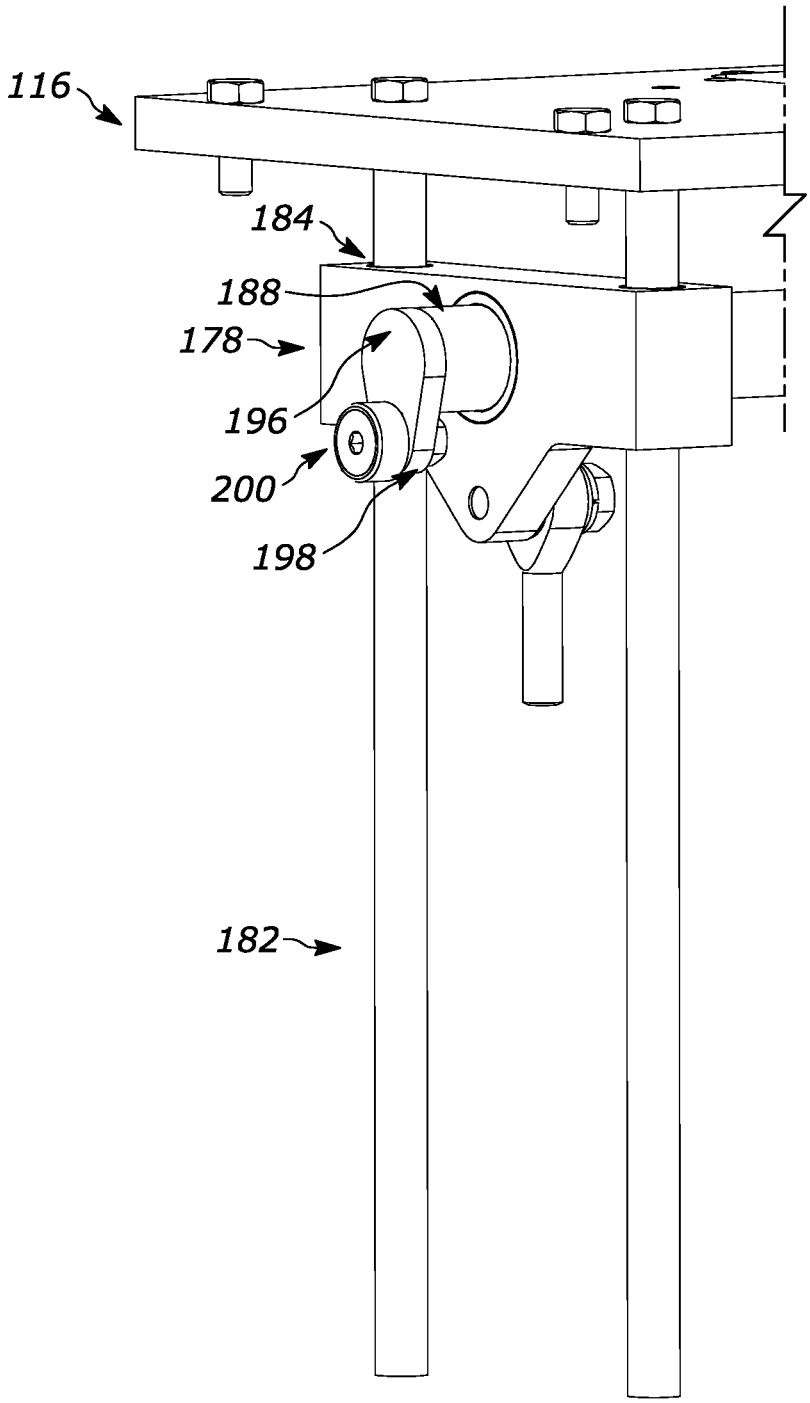
FIG. 18 of the drawings is a perspective view of a portion of the rotative movement assembly of the pick and place assembly of the present disclosure.
Figure 19:
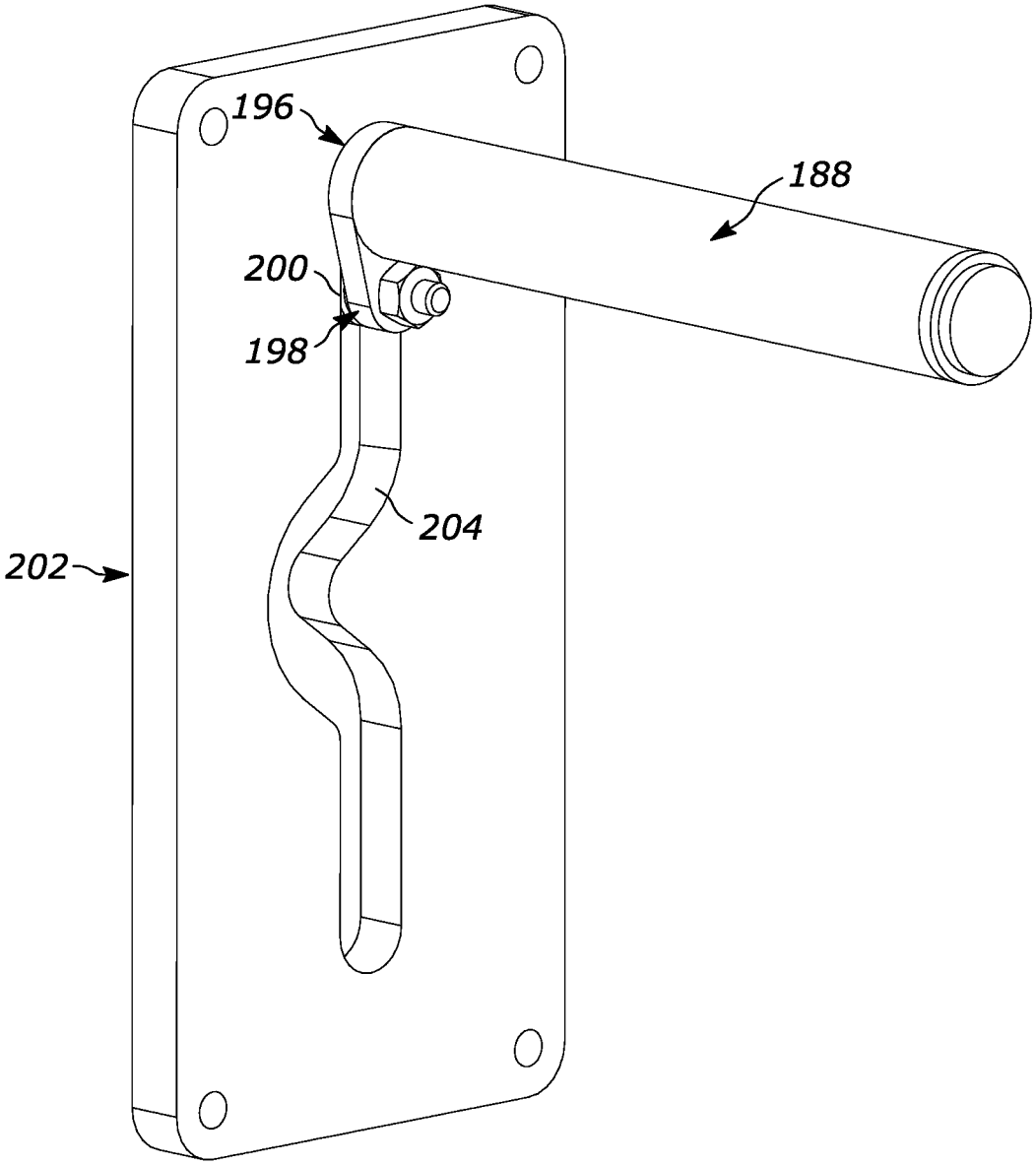
FIG. 19 of the drawings is a perspective view of a portion of the rotative movement assembly of the pick and place assembly of the present disclosure.

Referring additionally to FIGS. 5 through 7, the removable magazine assembly 12 comprises frame 20 and retaining assembly 60. The frame 20 is defined by lower end 22, upper end 24, and a plurality of elongated lid chambers 26. Further, the frame 20 includes a first end 28, second end 29, first side 30 and second side 32. It is contemplated that the removable magazine assembly includes multiple elongated lid chambers. For example, in the configuration shown, a total of sixteen elongated lid chambers are defined, in a two by eight configuration. Each such elongated lid chamber can retain between 10 and 800 lids, for example, while greater or fewer numbers of lids are contemplated depending on a plurality of factors. Of course, typically, the pattern and layout of the elongated lid chambers of the removable magazine assembly matches and/or corresponds to the elongated lid chamber of the primary magazine assembly and the suction cups.

The frame further is defined by base plate 34, columns, such as columns 36, and upper plate 38. The base plate 34 has a lower surface 40 and an upper surface 42, a plurality of chamber openings that correspond to each of the elongated lid chambers 26. In the configuration shown, the base plate is substantially planar and of a generally rectangular configuration. The transverse slots 46 extend from either the first side 30 or the second side 32 and into a chamber opening 44. In the configuration shown, a pair of transverse slots enter the chamber opening. The chamber openings are configured to match the configuration of the lid which will be utilized in the system. To prevent movement and the like, the chamber opening is configured to protect and prevent damage to the lids while retaining the lids and maintaining a column of lids in the desired configuration and orientation.

A plurality of columns, such as columns 36, extend between the base plate 34 and the upper plate 38. In the configuration shown, there are four columns associated with and serving to define the elongated lid chamber. The columns are strategically placed to effectuate the retention of the lids positioned within the chambers and also to limit damage thereto. It will be understood that while the columns are shown as generally cylindrical member, it is also contemplated that they may be of other shapes, such as polygonal or the like. In addition, the columns may be represented by sheets or material that partially or entirely surround the perimeter of the elongated lid chamber to define a tube or partial tube-like configuration. In other configurations, columns or similar structures such as those identified herein may be associated with a plurality of adjacent or closely positioned elongated lid chambers. In the configuration shown, the columns may be interference fit, threaded, adhered, keyed, or any combination thereof to one or both of the base plate and the upper plate. It will be understood that other structures may be used to attach the base plate and the upper plate, wherein the columns are sandwiched between the two plates (for example in bores associated with each plate).

Figure 20:
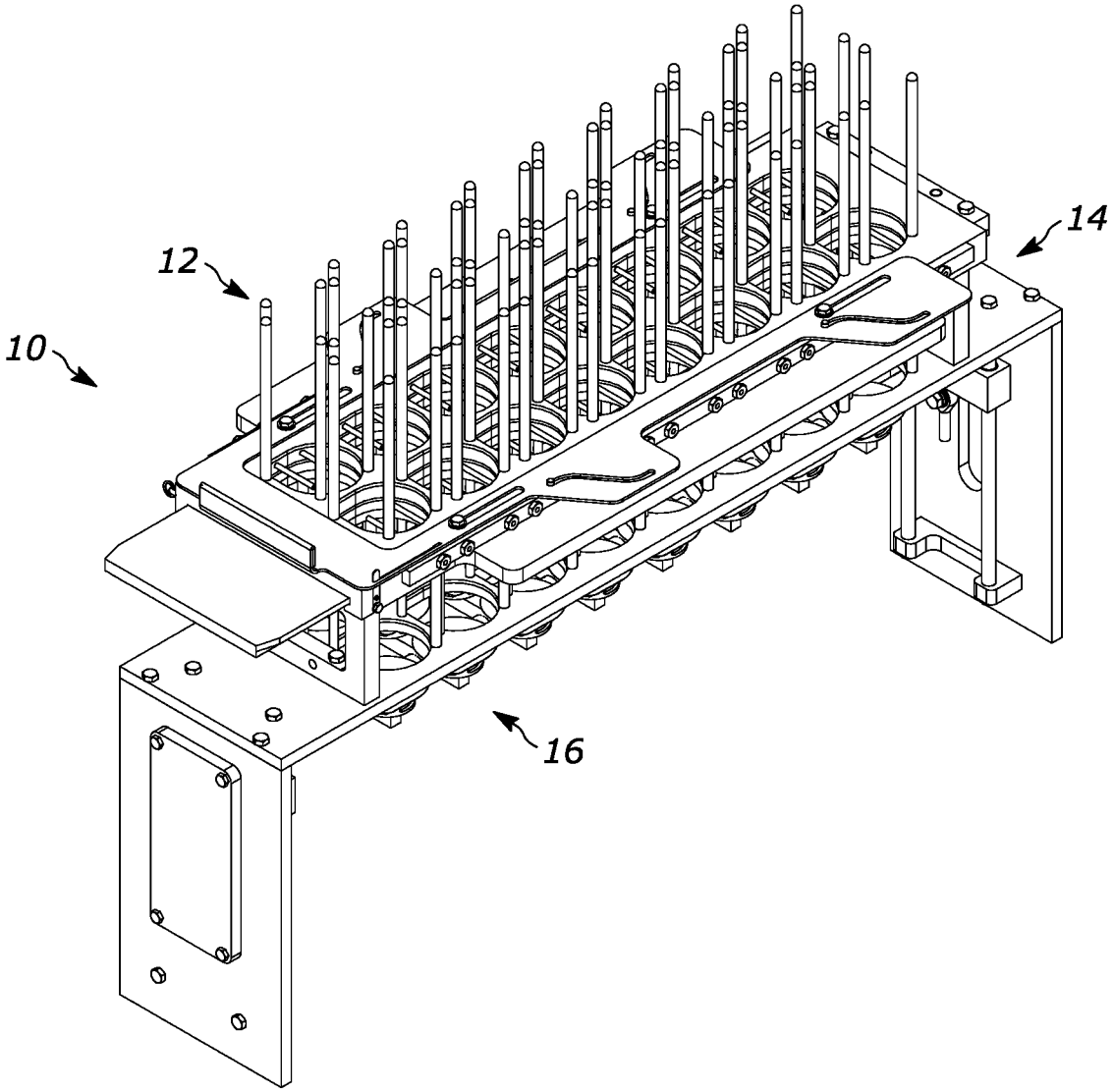
FIG. 20 of the drawings is a top perspective view of the pick and place system of the present disclosure, showing in particular, the omission of upper plate of the removable magazine assembly.

The upper plate 38 is shown as comprising lower surface 50, upper surface 52 and openings 54. The upper surface 52 is generally planar surrounding the openings 54 which shape correspond to the chamber openings 44 (and form the elongated lid chamber 26). A raised and rounded structure extends about the perimeter of the upper plate 38. In some configurations, with reference to FIGS. 20 and 21, the upper plate can be omitted. Such a configuration, in some situations can speed up filling of some types of lids.

It will be understood that the height of the removable magazine assembly can easily be varied by varying the length of the columns. That is, the columns can be lengthened or shortened so as to change the volume of the elongated lid chambers.

The lid retaining assembly 60 is configured to selectively block the elongated lid chambers at the chamber openings 44 of the base plate 34 to selectively allow or preclude the passage of lids beyond the base plate and out of the removable magazine assembly. The lid retaining assembly includes retainer pins 62, first side connecting rail 64, second side connecting rail 66 and the side rail assembly 68. The lid retainer pins have an inner end that is slidably insertable through respective ones of the transverse slots 46 in and out of the chamber openings 44. The lid retainer pins have an outer end which is coupled to one of the first side connecting rail 64 or the second side connecting rail 66.

Each connecting rail 64, 66 extends on either side of the base plate 34, and each respective rail is attached to an outer end of each of the retainer pins on the same side of the base plate. Thus, by moving the connecting rails toward or away from the base plate, the inner ends of the retainer pins can be simultaneously be directed into or out of a respective set of chamber openings. It will be understood that one of the rails corresponds to one of the two banks of elongated lid chambers, while the other one of the rails corresponds to the other of the two banks of elongated lid chambers. And, the rails can be moved independently of each other, or, as will be described below, can be moved in unison with each other, both toward each other and away from each other.

The slide rail assembly 68 provides coordinated movement of the connecting rails to simultaneously move the retainer pins in and out of the chamber openings 44. The side rail assembly comprises slide rail plate 80, frame movement guide assembly 82 and retainer pin movement guide assembly 88. The slide rail plate 80 is positioned so as to slide along the upper surface 42 of the base plate 34, generally around the chamber openings 44 and the columns 36.

The slidable movement of the slide rail plate 80 is limited and guided by the frame movement guide assembly 82. The frame movement guide assembly 82 includes pin members 84 and slots 86. The pin members 84 extend from the upper surface 42 of the base plate and extend through corresponding slots 86. As the plate moves, the slot traverses along the pin, with the movement being limited when the pin reaches an end of the slot. In the configuration shown, there are four slots and four corresponding pins, with the pin and slot combinations defining the relative movement of the slide rail plate relative to the base plate.

At the same time, the retainer pin movement guide assembly controls the movement of the connecting rails (and, in turn, the retainer pins) relative to the base plate. In particular, the retainer pin movement guide assembly 88 includes pin members 90 and slot members 92 which correspond to the pin members. The pin members act like followers and the slot members act like cams that direct the pin members/followers. In the configuration shown, as the slide rail plate is slid relative to the upper plate from the first end to the second end of the frame, the retainer pin movement guide assembly 88 directs the first and second side connecting rails toward or away from each other and the opposing sides of the frame. This, in turn, directs the retainer pins into and out of the chamber openings 44. It will be understood that the configuration of the slot members 92 can be modified so as to change the pattern of movement of the retainer pins.

It will be understood that the range of movement of the slide rail plate can be controlled by any one or more of the frame movement guide assembly, the retainer pin movement guide assembly or an interference between the slide rail plate and the base plate and/or the columns, or the retaining pins and the chamber openings.

With reference additionally to FIGS. 1, 3 and 4, the removable magazine assembly 12 is releasably attachable to the primary magazine assembly, and, the removable magazine assembly is generally configured to be removed, refilled with lids and reattached to the primary magazine assembly. And, at such time, the lids can be transferred from the removable magazine assembly to the primary magazine assembly. In the configuration shown, the removable magazine assembly can be slid relative to the primary magazine assembly utilizing the base attachment member (i.e., the longitudinal slots 56) which engage corresponding tabs formed in the outer upper plate of the primary magazine assembly.

The primary magazine assembly 14 is shown in greater detail in FIGS. 8 through 15 as comprising frame 100, guide rods, such as guide rod 150. The frame 100 defines lower end 102, upper end 104, elongated lid chambers 106, and is bounded by first end 108, second end 110, first side 112 and second side 114. The frame of the primary magazine assembly 14 and the frame of the removable magazine assembly substantially correspond, and do the elongated lid chambers of the primary magazine assembly and the elongated lid chambers of the removable magazine assembly so that lids in respective corresponding ones of the elongated lid chambers of the removable magazine assembly can easily pass to the elongated lid chambers of the primary magazine assembly as desired without damage and without impeding the flow therebetween.

The Frame 100 further includes base plate 116, inner upper plate 118 and outer upper plate 120. The base plate 116 includes lower surface 122, upper surface 124, guide rod bores 126 and lid bores 128. As with the other chamber openings and the like for the lids, the lid bores are configured to substantially match the configuration of the lids that are utilized with the assembly. Generally, the base plate is substantially planar with the guide rod bores extending about the circumference of the lid bores to form the elongated lid chambers when guide rods are mated with the guide rod bores.

The inner upper plate 118 is shown as comprising lower surface 130, upper surface 132, guide rod bores 134, key bores 136 and lid bores 138. The guide rods are locked into position by sandwiching the guide rod lock washer 164 within the annular slot of the guide rod when positioned within the key bores and guide rod bores, as will be explained below. As will be understood the inner upper plate is substantially planar and the lid bores 138 correspond in shape and position with the other structures that form the elongated lid chamber of the primary magazine assembly. A pair of opposing wall members can be utilized to couple the base plate and the inner upper plate (and optionally the outer upper plate) together and to maintain the separation therebetween.

The outer upper plate 120 includes lower surface 140, upper surface 142, guide rod bores 144 and lid bores 146. The outer upper plate extends over the sides of the inner upper plate so as to define a tab that allows for slidable engagement with the longitudinal slots of the base attachment member of the removable magazine assembly. The lower surface of the outer upper plate overlies the upper surface of the inner upper plate so as to cover the key bores and the guide rod bores of the inner upper plate. The lid bores 144 correspond with the lid bores 138.

With continued reference to FIGS. 8 through 15, and particular reference to FIGS. 11 through 15, the guide rods 150 each comprise body 152 with first end 160 and second end 162. A lower offset flange 154 is positioned at the second end 162. There can be a plurality of such guide rods about a single elongated lid chamber, or a plurality of such rods (for example, some rods can be replaced with other structures which may or may not have the lower offset flange). As will be explained, the lower offset flange comprises an eccentric or offset flange wo that the radial length of the flange varies about the outer perimeter of the guide rod. Depending on the radial position of the guide rod 150 within the guide rod bores 126 of the base plate, a portion of the lower offset flange can extend with varying degrees (or not at all) inwardly beyond the perimeter defined by the lid bore such that the lower offset flange is in the path of the travel of the lid out of the elongated lid chamber and would interfere with a lid passing through the lid bore, and can retain a lid positioned within the lid bore, while removal thereof by a vacuum suction device or otherwise can direct the lid beyond the lower offset flange without undesirably damaging the lid. At the first end is upper cap region 156 which is defined by the annular slot 158 spaced apart from the second end. The annular slot 158 is configured to receive the guide rod lock washer.

The guide rod 150 is installed by directing the guide rod through the respective guide rod bore 126 of the base plate 116 and then through the guide rod bore 134 of the inner upper plate. The guide rod is extended sufficiently so that the annular slot extends beyond the upper surface of the inner upper plate 118. At such time, the guide rod lock washer can be inserted into the annular slot, and the guide rod can be dropped to direct the annular slot into the respective key bore. Once in the key bore, the guide rod lock washer locks the guide rod bore and precludes removal of the guide rod through the guide rod bore. Additionally, the guide rod lock washer may be formed from a resilient material such that the guide rod can be rotated by hand by a user, and when released, the guide rod lock washer will preclude inadvertent rotation of the guide rod by providing a biasing force against the guide rod. In such a manner the amount that the lower offset flange 154 can be managed by rotating the guide rod and then releasing the guide rod, wherein the guide rod lock washer will maintain the position of the guide rod.

Once all of the guide rods are positioned and secured with their respective guide rod lock washers, the outer upper plate can be positioned over the inner upper plate so as to sandwich the guide rod lock washers into position, which, in turn, locks the guide rods longitudinally with the inner and outer upper plates, while allowing for relative rotation of each about their respective longitudinal axis. It will be understood that depending on the type of lid material and other characteristics thereof, the rods may be rotated so that a different amount of the lower offset flange extends beyond the perimeter of the lid bore 128 and into the path of oncoming lids.

The pick and place assembly 16 is shown in FIGS. 16 through 19 as comprising linear movement assembly 170 and rotative movement assembly 186. Functionally, the linear movement assembly and the rotative movement assembly cooperate to grasp the lids, move the lids away from the primary magazine assembly and rotate the lids for placement onto cups (not shown). The linear movement assembly 170 includes linear frame 172, first linear guides 174, second linear guides 176, first slide block 178 and second slide block 180. The linear movement assembly facilitates the linear movement of the lids away from the primary magazine assembly at which time the rotative movement assembly cooperatively rotates the lids.

The linear frame 172 has opposing legs, namely, first leg 182 and second leg 183 spaced from the first leg, and coupled to the lower end 102 of the frame 100 of the primary magazine assembly. In the configuration shown, the first leg is positioned at the first end and the second leg is positioned at the second end of the frame. Linear guide 174 is attached to the first leg 182 and second linear guide 176 is attached to the second leg 183. Each of the linear guides 174, 176 comprise a pair of spaced apart elongated rods (of circular cross-section, in the configuration shown) that are generally perpendicular to the lower surface 122 of the base plate 116.

The first slide block 178 is slidably coupled to the linear guides 174 about openings 184, and the second slide block 180 is slidably coupled to the linear guides 176 about openings 185, such that the slide blocks can slidably move toward and away from the lower surface of the base plate 116 of the frame of the primary magazine assembly.

The rotative movement assembly 186 comprises vacuum assembly 187, connecting arm 196, follower 200, cam plate 202 and drive wheel 206. The vacuum assembly 187 includes connecting rod 188, transverse mounts 189, suction cup tubes 190 and suction cups 192. The connecting arm 196 runs generally parallel to the lower surface of the base plate 116 through connecting rod bore 175 in the first slide block 178 and through the connecting rod bore 177 in the second slide block 180. As a result, as the slide blocks are moved up and down, the vacuum assembly moves toward and away from the base plate. The connecting rod further includes a central bore 194.

A plurality of transverse mounts 189 each having an internal bore that is in fluid communication with the central bore 194. The transverse mounts correspond to each pair of adjacent elongated lid chambers, and terminate proximate the central region of each of the lid bores of the base plate 116. A suction cup tube mount 190, to which a suction cup 192 is coupled, is mounted to the transverse mount so that the suction cup is in fluid communication with the central bore 194. The suction cups are sized so as to extend toward each lid bore of the base plate generally centrally therein so as to grasp and retain through vacuum a lid, wherein the vacuum retaining force is sufficient to move the lid beyond the lower offset flanges of the guide rods that are holding the lid within the lid bores. As shown, the suction cups are positioned and oriented so that, in unison, they grasp and retain the lowest lid from each of the elongated lid chambers.

The connecting rod 196 is fixed to an end of the connecting rod extending through the first slide block 178 wherein the distal end 198 is positioned radially away from a longitudinal axis of the connecting rod. A follower, such as follower 200 is rotatably coupled to the distal end 198 of the connecting arm 196. The follower is sized so as to fit within the cam surface 204 of the cam plate 202 which is mounted to the first leg 182 of the linear frame 172.

The cam surface configuration causes the rotation of the connecting rod through a rotation of approximately 180°, or about half of a rotation. In particular, the cam surface 204 is configured so that as the follower proceeds through the cam surface 204 from a first end (proximate the base plate) to a second end (distally spaced from the base plate), the follower begins to rotate the connecting arm, which then rotates the connecting rod 188. Such rotation occurs only after the connecting rod (and the lids retained by the suction cups) are moved sufficiently away from the base plate 116 so as to allow for rotation of the vacuum assembly without hitting the base plate 116.

It will be understood that after rotation, the vacuum can be cut off, and the lids can be released from the vacuum assembly. At such time, the vacuum assembly returns toward the base plate to engage the next set of lids. Through the return, of the slide blocks toward the base plate, the connecting rod again rotates approximately 180° back to its original position described above. The movement of the pick and place assembly may be done through a drive wheel, linkages or the like to a servo or to another rotative device, which then imparts linear movement to the linear movement assembly. Vacuum can be supplied to the vacuum assembly through a vacuum pump or other apparatus that is coupled and in fluid communication with the vacuum assembly. Such vacuum can be controlled through any number of different structures and assemblies as is known to one of skill in the art.

In operation, a user first fills the removable magazine assembly 12 with lids. Prior to inserting the lids, the slide rail assembly is slidably moved against the base plate to direct the retainer pins 62 into the chamber openings. This precludes the passage of lids through the chamber opening in the base plate of the frame. In the configuration shown, lids can be stacked up in each of the elongated lid chambers 26.

Once loaded, the user can couple the removable magazine assembly to the primary magazine assembly. This is achieved by slidably directing the removable magazine relative to the primary magazine, to have the sides of the outer upper plate navigate into an then along the longitudinal slots 56 of the base attachment member of the removable magazine assembly. Once the two structure align their respective elongated lid chambers, the user, can allow the lids to move from the removable magazine assembly to the primary magazine assembly.

To achieve the movement of lids from one assembly to the other, the user can again slide the slide rail plate which causes the retainer pin movement guide assembly to direct the retainer pins from within the chamber openings and to allow for the passage of lids into the elongated lid chamber 106 of the primary magazine assembly. As the lids reach the base plate and the lid bores 128 of the base plate of the primary magazine assembly 14, the lids encounter, typically, a plurality of lower offset flanges 154 which intrude beyond the perimeter of the lid bores 128 and into the path of the elongated lid chamber to preclude movement of the lid out of the elongated lid chamber. The lowermost lid engages the lower offset flanges and passage through the lid bore is precluded by the lower offset flanges.

The pick and place assembly can be activated to sequentially remove lids from the primary magazine assembly for application onto cups (which is deemed to comprise all types of containers). The pick and place assembly is configured to simultaneously grasp the lowermost lid in each of the lid bores of the base plate and move these away from the primary magazine assembly and onto another surface (such as the perimeter of a plurality of cups, or another surface onto which they can be attached, or further processed). This is achieved by moving the suction cups 192 into contact with the lowermost lid in each of the lid bores. At such time, (or prior thereto) a vacuum is pulled so that the lids become releasably secured to the suction cups.

Figure 21:
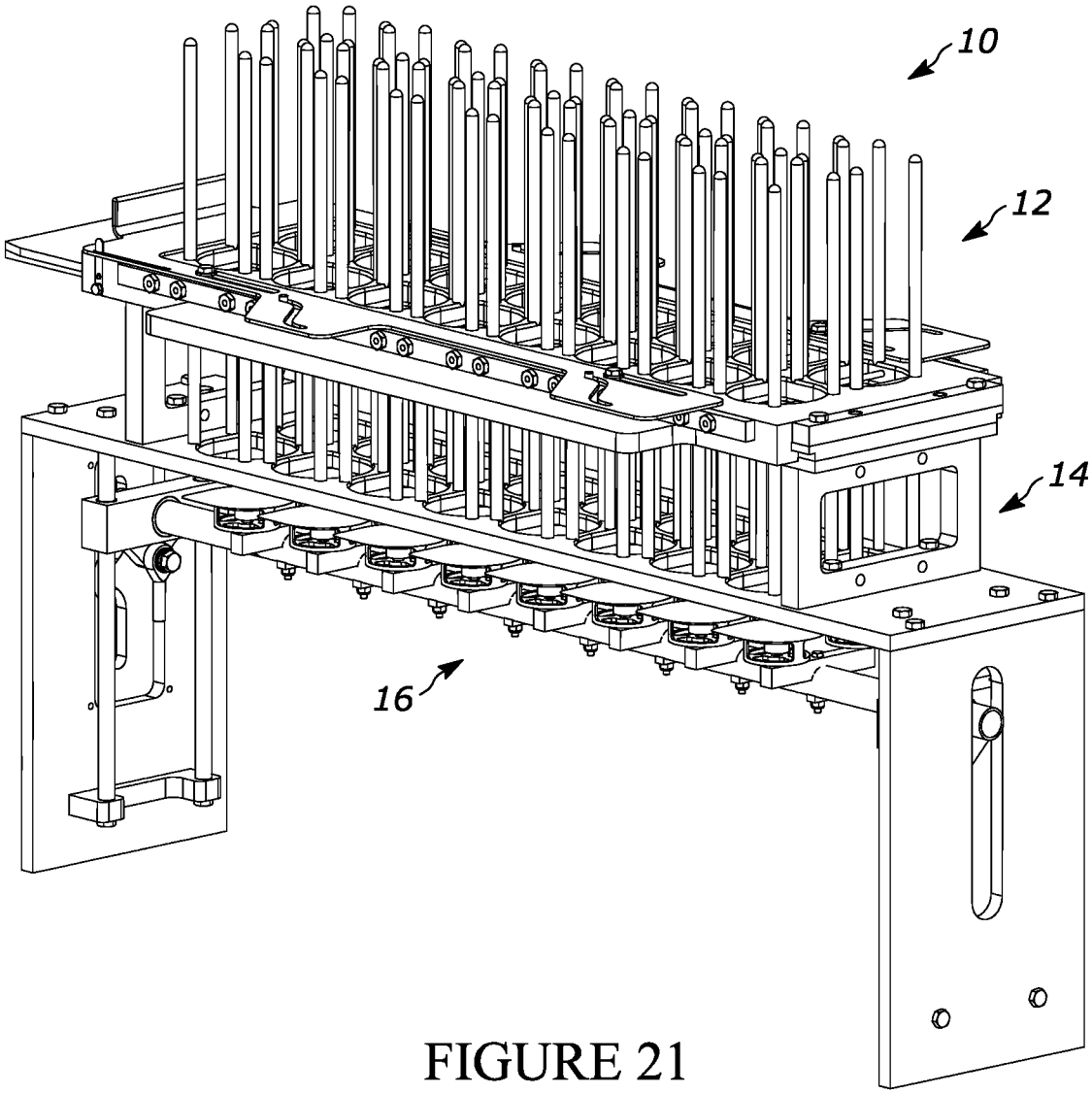
FIG. 21 of the drawings is a bottom perspective view of the pick and place system of the present disclosure, showing in particular, the omission of the upper plate of the removable magazine assembly.
Figure 22:
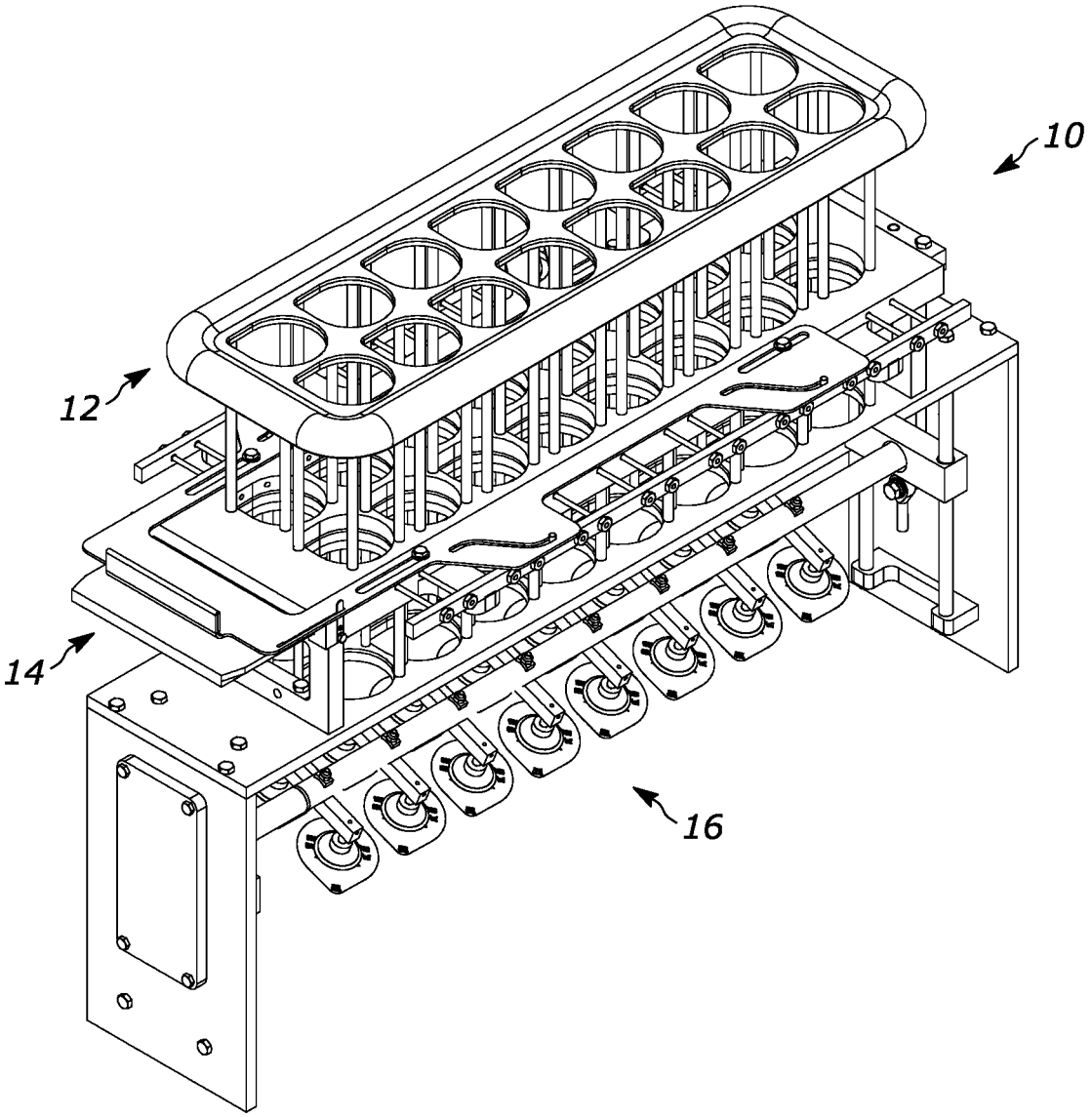
FIG. 22 of the drawings is a perspective view of the pick and place assembly of the present disclosure showing the rotation of the connecting rod (and lids) as the follower traverses between the first and second ends of the cam surface.
Figure 23:
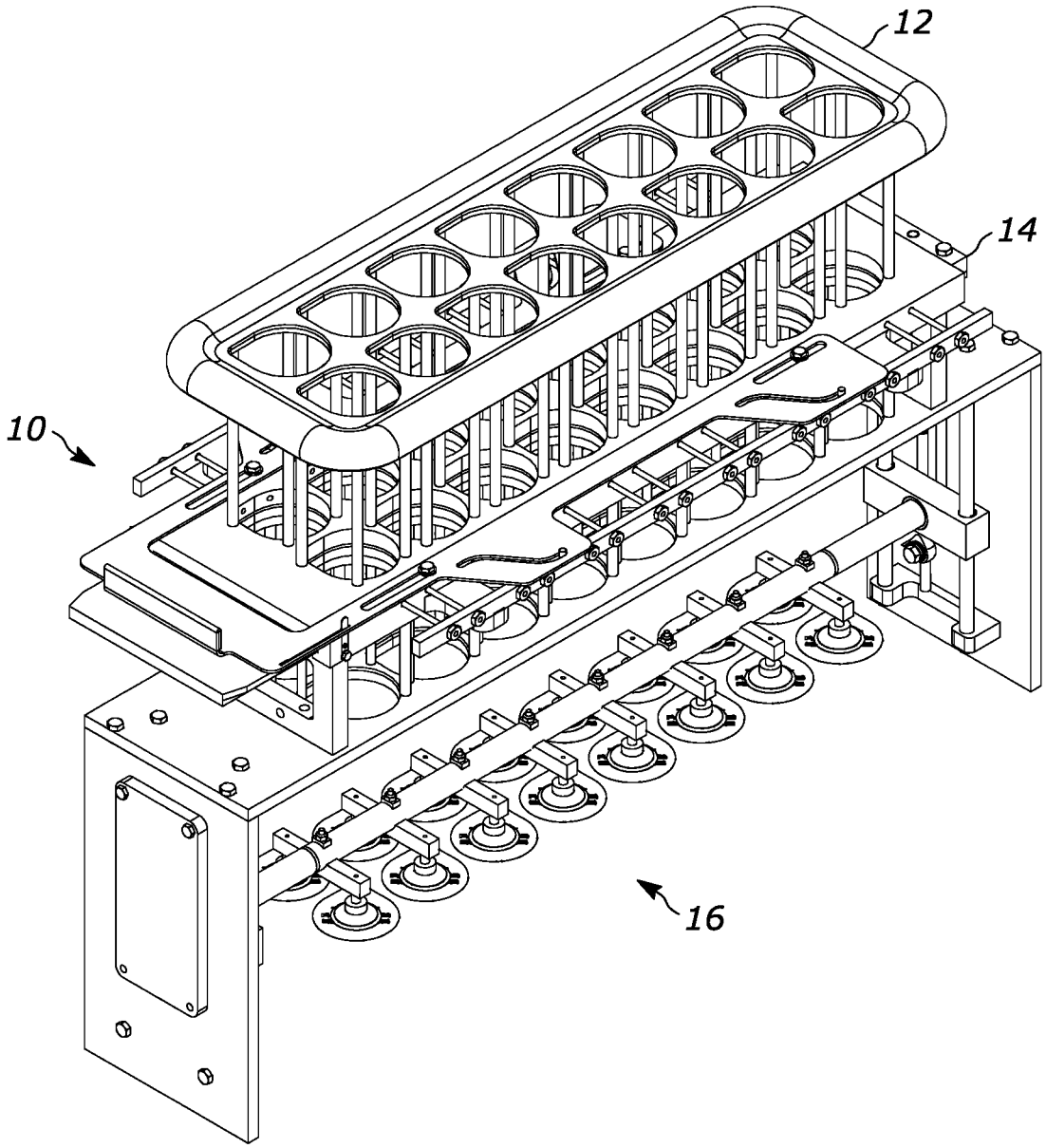
FIG. 23 of the drawings is a perspective view of the pick and place assembly of the present disclosure showing the continued movement after that which is shown in FIG. 22, completing rotation of the connecting rod (and lids) approximately half of a rotation so that the lids are facing downwardly as the connecting rod is directed away from the base plate of the primary magazine assembly.
Figure 24:
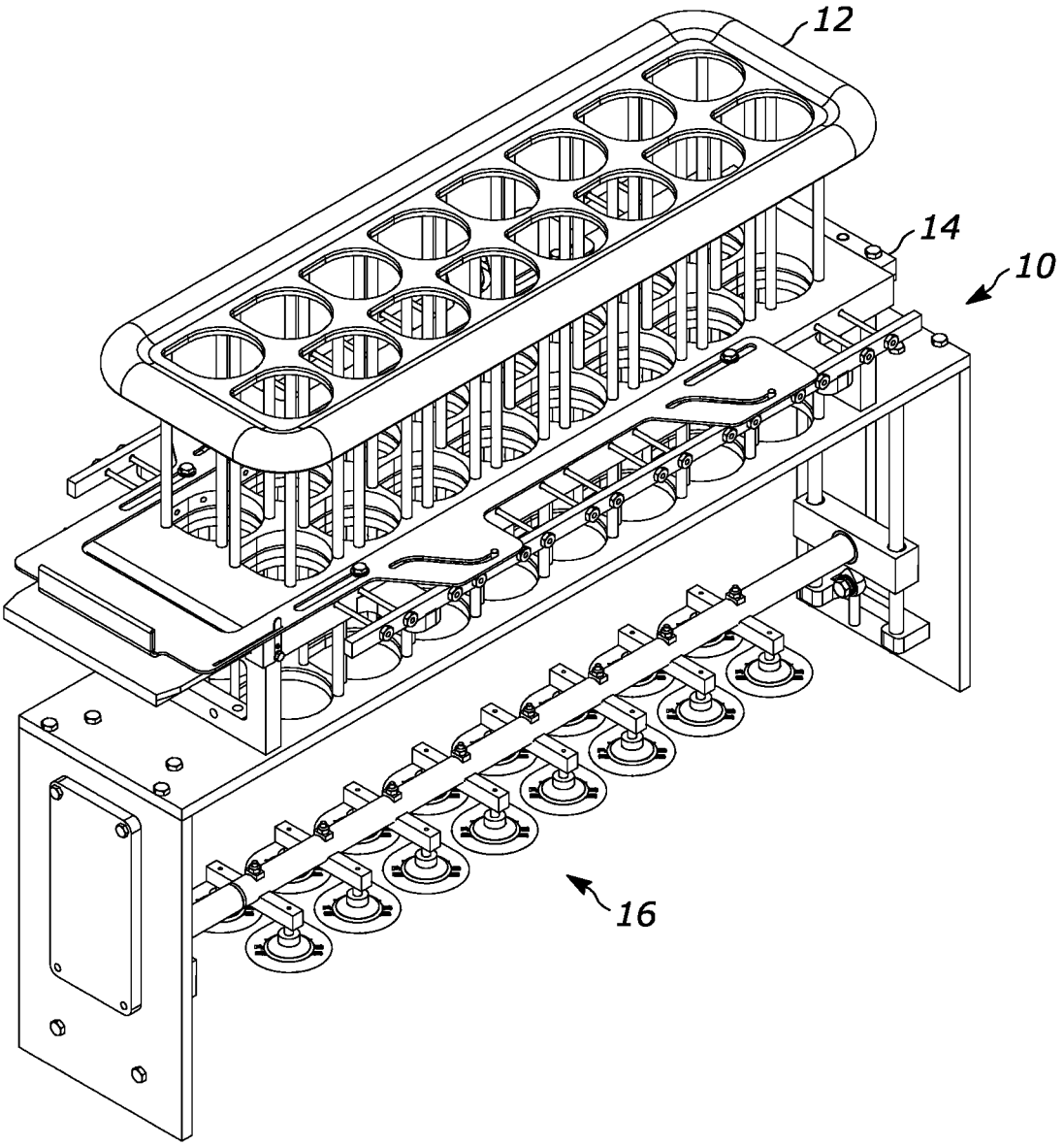
FIG. 24 of the drawings is a perspective view of the pick and place assembly of the present disclosure showing the linear movement away from the base plate of the primary magazine assembly with further motion after that which is shown in FIG. 23.

Once the releasable securement is complete, the connecting rod, and the first and second slide blocks are moved away from the base plate. As they are moved away, and the slide blocks move along the respective linear guides, the follower 200 moves along the cam surface 204. With reference to FIG. 21, the initial movement is in a downward direction. Continued movement away from the base plate, directs the follower further along the cam surface 204. As the follower progresses, the cam is configured to cause rotation to the connecting arm 196, and, in turn, the connecting rod, causing the entire vacuum assembly to rotate. This can be seen in FIG. 22. In the configuration shown, the lids are eventually rotated through approximately 180° from their position within the lid bores. This can be seen in FIG. 23. Once rotated, the lids can continue linearly to approach the end of travel at which time they can be released by the suction cups for further processing. This can be seen in FIG. 24.

As explained above, the vacuum assembly moves back to its original configuration to pick up the now lowermost lids within the lid bores of the base plate of the primary magazine assembly. In the configuration shown, the cam surface is configured to allow for no, small or minimal rotation (i.e., primarily linear movement) proximate the first end and the second end of the cam surface, with rotation occurring between the first and second ends. Of course, in other configurations, the cam surface can be altered to have combined linear and rotative movement proximate the first and second ends, while precluding inadvertent contact of the lids with the primary magazine assembly or the further processing, which may be due to non linear movement.

While the lids are rotating and translating by the pick and place assembly 16, the lower offset flange of the guide rods within the primary magazine assembly precluded further lids from falling out of the primary magazine assembly. That is, the lids remain retained by the lower offset flange until the vacuum assembly releasably secures the lids and forceably removes the lids from the respective lid bores.

While the system is in a steady state running condition, wherein the pick and place assembly repeatedly removes the lowermost lids from each of the lid bores, the removable magazine assembly can be decoupled from the primary magazine assembly, refilled with lids and reattached to the primary magazine assembly. It is further contemplated that multiple removable magazine assemblies can be utilized with a single primary magazine assembly so that more time can be taken to refill the lids into the removable magazine assembly than it takes for the primary magazine assembly to be emptied. It is further contemplated that a removable magazine assembly may be sized to hold a differing amount of labels than the primary magazine assembly. For example, the removable magazine assembly may retain fewer lids in each elongated lid chamber than are retained within the elongated lid chamber of the primary magazine assembly. Conversely, the removable magazine assembly may retain a greater number of lids in each elongated lid chamber than are retained within the elongated lid chamber. In still other configurations, they may be the same.

It will be understood that the system may be adapted to handle lids of any number of different shapes, sizes, thicknesses and the like. The position of the lower offset flange can be adapted to suit any number of different type of lid materials and configurations by simply rotating the guide rods. Furthermore, it will be understood that the configuration, number and position of the guide rods can be modified depending on any number of factors. Moreover, while two columns of a plurality of elongated lid chambers are shown, it is contemplated that a greater or fewer number of elongated lid chambers can be utilized. For example, there may be as few as a single lid bore in some configurations). In addition, it is contemplated that less than all of the elongated lid chambers may be utilized in some systems. For example, while a total of sixteen are shown, at any time, one or more of the chambers may be without lids. In addition, in a number of configurations, it is contemplated that some chambers may run out of lids prior to other chambers running out of lids. It is further contemplated, that systems other than vacuum may be utilized to releasably couple to the lowermost lid to remove the same from the system.

The foregoing description merely explains and illustrates the disclosure and the disclosure is not limited thereto except insofar as the appended claims are so limited, as those skilled in the art who have the disclosure before them will be able to make modifications without departing from the scope of the disclosure.

What is claimed is:

1. A lid pick and place system comprising:

a primary magazine assembly including:

a base plate having a lower surface, an upper surface, and at least one lid bore, the at least one lid bore defining a lid bore perimeter having at least one guide rod bore extending therethrough; and at least one guide rod extending from the base plate to define an elongated lid chamber collectively with the at least one lid bore, the at least one guide rod having a body with a first end and a second end, and a lower offset flange at the second end, with the at least one guide rod extending through the at least one guide rod bore so that the lower offset flange approaches the lower surface of the base plate, wherein rotation of the at least one guide rod within the at least one guide rod bore directs at least a portion of the lower offset flange beyond the lid bore perimeter and into a path of the elongated lid chamber; and a pick and place assembly including:

a connecting rod having at least one suction cup mounted thereto and positionable so as to underlie the lower surface of the base plate within the path of the elongated lid chamber;

a linear movement assembly structurally configured to move the connecting rod linearly closer to and further from the lower surface of the base plate; and a rotative movement assembly structurally configured to rotate the connecting rod relative to the lower surface of the base plate;

wherein the linear movement assembly further comprises a pair of opposing linear guides fixed relative to the base plate, each linear guide having a slide block slidably movable therealong, with the connecting rod being rotatably attached to each of the slide blocks;

wherein the rotative movement assembly further comprises:

a connecting arm coupled to the connecting rod, the connecting arm having a distal end spaced apart from an axis of rotation of the connecting arm, with a follower mounted proximate to the distal end; and a cam plate fixed relative to the base plate and including a cam surface, with the follower positionable within the cam surface and movable therewithin between a first end and a second end of the cam surface; and wherein movement of the follower between the first end and the second end of the cam surface causes the connecting arm to rotate relative to the slide blocks about the axis of rotation.

2. The lid pick and place system of claim 1 wherein the cam surface is configured to allow the connecting arm to linearly move without rotation proximate to the first end of the cam surface and proximate to the second end of the cam surface.

3. The lid pick and place system of claim 1 wherein the connecting arm rotates through 180° of rotation.

4. The lid pick and place system of claim 1 wherein the follower is rotatably coupled to the distal end of the connecting arm.

5. The lid pick and place system of claim 1 wherein the rotative movement assembly comprises a vacuum assembly, and wherein the vacuum assembly comprises a plurality of transverse mounts spaced apart from each other along the connecting rod, each transverse mount having opposing ends with a suction cup associated with each of the opposing ends of the transverse mounts, with each of the suction cups being in fluid communication with a central bore of the connecting rod.

6. The lid pick and place system of claim 1 wherein each of the opposing linear guides comprises a pair of spaced apart elongated rods, with each slide block having a pair of spaced apart openings slidably engageable with one of the spaced apart elongated rods.

7. The lid pick and place system of claim 1 wherein the at least one guide rod further includes a plurality of guide rods associated with each of the at least one lid bore, each of the guide rods positioned so that the lower offset flange is positionable within the path of the elongated lid chamber.

8. The lid pick and place system of claim 1 wherein the at least one guide rod comprises a plurality of guide rods positioned about the lid bore perimeter of the at least one lid bore.

9. The lid pick and place system of claim 1 further comprising a removable magazine assembly attachable to the primary magazine assembly, the removable magazine assembly having at least one removable elongated lid chamber positionable to correspond to the elongated lid chamber of the primary magazine assembly, so as to direct lids from the removable magazine assembly into the elongated lid chamber of the primary magazine assembly.

10. A lid pick and place system comprising:

a primary magazine assembly including:

a base plate having a lower surface, an upper surface, and at least one lid bore, the at least one lid bore defining a lid bore perimeter having at least one guide rod bore extending therethrough; and at least one guide rod extending from the base plate to define an elongated lid chamber collectively with the at least one lid bore, the at least one guide rod having a body with a first end and a second end, and a lower offset flange at the second end, with the at least one guide rod extending through the at least one guide rod bore so that the lower offset flange approaches the lower surface of the base plate, wherein rotation of the at least one guide rod within the at least one guide rod bore directs at least a portion of the lower offset flange beyond the lid bore perimeter and into a path of the elongated lid chamber;

a pick and place assembly including:

a connecting rod having at least one suction cup mounted thereto and positionable so as to underlie the lower surface of the base plate within the path of the elongated lid chamber;

a linear movement assembly structurally configured to move the connecting rod linearly closer to and further from the lower surface of the base plate; and a rotative movement assembly structurally configured to rotate the connecting rod relative to the lower surface of the base plate; and a removable magazine assembly attachable to the primary magazine assembly, the removable magazine assembly having at least one removable elongated lid chamber positionable to correspond to the elongated lid chamber of the primary magazine assembly, so as to direct lids from the removable magazine assembly into the elongated lid chamber of the primary magazine assembly;

wherein the removable magazine assembly further includes a lid retaining assembly structurally configured so that lids are selectively precluded from passage out of the removable magazine assembly and into the primary magazine assembly.

11. The lid pick and place system of claim 10 wherein the lid retaining assembly comprises at least one retainer pin selectively insertable into a path of the at least one removable elongated lid chamber, to, in turn, selectively block the path.

12. A lid pick and place system comprising:

a primary magazine assembly including:

a base plate having a lower surface, an upper surface, and at least one lid bore, the at least one lid bore defining a lid bore perimeter having at least one guide rod bore extending therethrough; and at least one guide rod extending from the base plate to define an elongated lid chamber collectively with the at least one lid bore, the at least one guide rod having a body with a first end and a second end, and a lower offset flange at the second end, with the at least one guide rod extending through the at least one guide rod bore so that the lower offset flange approaches the lower surface of the base plate, wherein rotation of the at least one guide rod within the at least one guide rod bore directs at least a portion of the lower offset flange beyond the lid bore perimeter and into a path of the elongated lid chamber; and a pick and place assembly including:

a connecting rod having at least one suction cup mounted thereto and positionable so as to underlie the lower surface of the base plate within the path of the elongated lid chamber;

a linear movement assembly structurally configured to move the connecting rod linearly closer to and further from the lower surface of the base plate; and a rotative movement assembly structurally configured to rotate the connecting rod relative to the lower surface of the base plate;

wherein the primary magazine assembly further comprises an inner upper plate, the inner upper plate having a lower surface, an upper surface, at least one upper lid bore corresponding to the at least one lid bore of the base plate, at least one upper guide rod bore corresponding to the at least one guide rod bore of the base plate, and a key bore associated with the at least one upper lid bore;

wherein the at least one guide rod further includes an annular slot spaced apart from the second end to define an upper cap region, and a guide rod lock washer insertable within the annular slot;

wherein upon insertion of the guide rod lock washer into the annular slot, the guide rod lock washer is inserted into the key bore; and wherein the primary magazine assembly further comprises an outer upper plate securable to the upper surface of the inner upper plate, the outer upper plate sandwiching the guide rod lock washer within the key bore to preclude slidable movement between the at least one guide rod and the inner upper plate, while facilitating rotative movement therebetween.

13. The lid pick and place system of claim 12 wherein the guide rod lock washer is biased against the at least one guide rod within the key bore, to preclude inadvertent rotational movement of the at least one guide rod relative to the inner upper plate.

14. A pick and place assembly for a lid pick and place system, the pick and place assembly comprising:

a connecting rod having at least one suction cup mounted thereto and positionable so as to underlie a lower surface of a base plate within a path of an elongated lid chamber;

a linear movement assembly structurally configured to move the connecting rod linearly closer to and further from the lower surface of the base plate; and a rotative movement assembly structurally configured to rotate the connecting rod relative to the lower surface of the base plate;

wherein the linear movement assembly further comprises a pair of opposing linear guides fixed relative to the base plate, each linear guide having a slide block slidably movable therealong, with the connecting rod being rotatably attached to each of the slide blocks;

wherein the rotative movement assembly further comprises:

a connecting arm coupled to the connecting rod, the connecting arm having a distal end spaced apart from an axis of rotation of the connecting arm, with a follower mounted proximate to the distal end; and a cam plate fixed relative to the base plate and including a cam surface, with the follower positionable within the cam surface and movable therewithin between a first end and a second end of the cam surface; and wherein movement of the follower between the first end and the second end of the cam surface causes the connecting arm to rotate relative to the slide blocks about the axis of rotation.

* * * * *